US011091848B2

(12) United States Patent
Tajiri et al.

(10) Patent No.: US 11,091,848 B2
(45) Date of Patent: Aug. 17, 2021

(54) COMPONENT WITH DIFFERING MATERIAL PROPERTIES

(71) Applicant: Unison Industries, LLC, Jacksonville, FL (US)

(72) Inventors: Gordan Tajiri, Waynesville, OH (US); Donald Templeton, Beavercreek, OH (US); Dattu G V Jonnalagadda, Ponnur (IN); Yanzhe Yang, Mason, OH (US)

(73) Assignee: Unison Industries, LLC, Jacksonville, FL (US)

( * ) Notice: Subject to any disclaimer, the term of this patent is extended or adjusted under 35 U.S.C. 154(b) by 274 days.

(21) Appl. No.: 15/592,717

(22) Filed: May 11, 2017

(65) Prior Publication Data

US 2018/0327920 A1 Nov. 15, 2018

(51) Int. Cl.

| | |
|---|---|
| ***C25D 1/02*** | (2006.01) |
| ***F28D 1/02*** | (2006.01) |
| ***F28F 3/02*** | (2006.01) |
| ***F28F 9/007*** | (2006.01) |
| ***F28F 9/02*** | (2006.01) |
| ***F28F 1/40*** | (2006.01) |
| ***F28D 1/03*** | (2006.01) |
| ***F28F 9/26*** | (2006.01) |

(Continued)

(52) U.S. Cl.

CPC ..... *C25D 1/02* (2013.01); *B21D 53/08* (2013.01); *C25D 1/00* (2013.01); *C25D 1/16* (2013.01); *F28D 1/0246* (2013.01); *F28D 1/03* (2013.01); *F28D 1/0391* (2013.01); *F28F 1/34* (2013.01); *F28F 1/40* (2013.01); *F28F 3/027* (2013.01); *F28F 9/0075* (2013.01); *F28F 9/0202* (2013.01); *F28F 9/0253* (2013.01); *F28F 9/26* (2013.01); *F28D 2021/0021* (2013.01); *F28D 2021/0026* (2013.01)

(58) Field of Classification Search

None

See application file for complete search history.

(56) References Cited

U.S. PATENT DOCUMENTS

| | | | |
|---|---|---|---|
| 4,693,073 A | 9/1987 | Blackburn | |
| 5,199,487 A | 4/1993 | DiFrancesco et al. | |

(Continued)

FOREIGN PATENT DOCUMENTS

| | | | | |
|---|---|---|---|---|
| CN | 101903566 A | | 12/2010 | |
| CN | 102373497 | * | 3/2012 | ..... C25D 21/12 |

(Continued)

OTHER PUBLICATIONS

Chinese Patent Office, First Office Action re Application No. 201810453269.3, dated Sep. 17, 2019, 9 pages, China.

(Continued)

*Primary Examiner* — Stefanie S Wittenberg

(74) *Attorney, Agent, or Firm* — Dinsmore & Shohl LLP

(57) ABSTRACT

A component can be formed having an integral monolithic body. The integral monolithic body can be formed utilizing electroforming processes such as electrodeposition of metal alloys. The electroformed monolithic body can be formed utilizing multiple anodes powered by multiple power sources. The monolithic body can have differing local material properties determined during formation of the component.

20 Claims, 18 Drawing Sheets

(51) Int. Cl.

| | |
|---|---|
| ***C25D 1/00*** | (2006.01) |
| ***B21D 53/08*** | (2006.01) |
| ***C25D 1/16*** | (2006.01) |
| ***F28F 1/34*** | (2006.01) |
| *F28D 21/00* | (2006.01) |

(56) References Cited

U.S. PATENT DOCUMENTS

| | | | | |
|---|---|---|---|---|
| 7,810,552 | B2 | 10/2010 | Slaughter | |
| 7,866,377 | B2 | 1/2011 | Slaughter | |
| 8,061,032 | B2 | 11/2011 | Banham et al. | |
| 9,005,420 | B2 | 4/2015 | Tomantschger et al. | |
| 9,719,182 | B2 | 8/2017 | Agustoni | |
| 9,783,907 | B2 | 10/2017 | Cai et al. | |
| 2003/0026697 | A1* | 2/2003 | Subramanian | F01D 5/187 416/97 R |
| 2007/0134908 | A1* | 6/2007 | Banham | F23R 3/005 438/619 |
| 2009/0159451 | A1* | 6/2009 | Tomantschger | C25D 1/00 205/96 |
| 2010/0076556 | A1 | 3/2010 | Tomantschger et al. | |
| 2016/0017509 | A1* | 1/2016 | Agustoni | C25D 1/003 368/276 |
| 2016/0108813 | A1 | 4/2016 | Schmitz | |
| 2016/0341495 | A1 | 11/2016 | Hemker et al. | |
| 2016/0377350 | A1 | 12/2016 | Jensen et al. | |
| 2017/0049008 | A1* | 2/2017 | Pascall | F28F 21/04 |

FOREIGN PATENT DOCUMENTS

| | | | |
|---|---|---|---|
| CN | 105301945 | A | 2/2016 |
| JP | 59-150094 | A | 8/1984 |
| JP | 02197591 | A | 8/1990 |
| JP | 09201834 | A | 8/1997 |
| JP | 2002241982 | A | 8/2002 |
| JP | 2007512434 | A | 5/2007 |
| JP | 2009021479 | A | 1/2009 |
| JP | 2010159470 | A | 7/2010 |
| JP | 2014122383 | A | 7/2014 |
| JP | 2014521840 | A | 8/2014 |

OTHER PUBLICATIONS

Extended European Search Report and Opinion issued in connection with corresponding EP Application No. 18171863.6 dated Sep. 17, 2018.

Japanese Patent Office, Office Action re Japanese Patent Application No. 2018-091110, dated Oct. 29, 2019, 6 pages, Japan.

Chinese office action for application 201810456269.3 dated Feb. 22, 2021 (15 pages with English Translation).

English Translation of Japanese office action for application 2018-091110 dated Jun. 11, 2020 (12 pages).

* cited by examiner

COMPONENT WITH DIFFERING MATERIAL PROPERTIES

BACKGROUND OF THE INVENTION

Contemporary components are formed using a combination of elements, or are machined to form the particular structures desired for the component. Such combining or machining is expensive and can be complex, which can negatively impact production yields.

Additionally, such contemporary components can only have a single material property. In order to achieve a component having multiple material properties, different elements are required to be combined, increasing cost and complexity of the component as well as requiring increased maintenance with reduced component lifetime.

BRIEF DESCRIPTION OF THE INVENTION

In one aspect, the disclosure relates to a method of forming a component including providing a sacrificial mold having an outer surface; forming a monolithic component by way of electroforming over the outer surface of the mold utilizing a single metal constituent solution and where the monolithic component includes zones having differing material properties; and removing the sacrificial mold.

In another aspect, the disclosure relates to a method of forming a component including attaching at least one sacrificial mold having an outer surface to a base plate; electroforming a metallic layer over exposed surfaces of the base plate and the outer surface of the sacrificial mold where the metallic layer includes zones having differing material properties; and removing at least one sacrificial mold to define the component.

In yet another aspect, the disclosure relates to a component including an integral monolithic body having at least two portions that have differing localized material properties.

DESCRIPTION OF EMBODIMENTS OF THE INVENTION

Embodiments disclosed herein relate to heat exchangers and more particularly to a convectively cooled heat exchanger utilizing a cool flow of fluid passing along one or more fins to cool the a hot fluid within the heat exchanger. The heat exchanger can mount along a casing in an engine such as an aircraft engine where a flow of air can provide the cooled flow. The exemplary heat exchangers can be used for providing efficient cooling. Further, the term "heat exchangers" as used herein can be used interchangeably with the term "cooler" or "surface coolers." Additionally, the heat exchanger as described herein illustrates an exemplary monolithic body for a component. It should be appreciated that the monolithic body is illustrated in exemplary form as the heat exchanger and can encompass a wide variety of components. As used herein, the heat exchangers are applicable to various types of applications such as, but not limited to, turbojets, turbo fans, turbo propulsion engines, aircraft engines, gas turbines, steam turbines, wind turbines, and water turbines. As used herein, a "set" can include any number of elements, including only one. "Integral monolithic body" or "monolithic body" as used herein means a single body that is a single, non-separable piece.

Traditional heat exchangers and heat exchanger assemblies are complex and can include multiple interconnected parts. Such heat exchangers can be expensive and labor intensive, while requiring significant maintenance. Similarly, present heat exchangers are not adapted to optimize heat transfer at thermal transfer surfaces or adapted to optimize strength at areas spaced from thermal transfer surfaces.

Additionally, embodiments disclosed herein relate to components having a monolithic body that is separated into different zones that have different material properties. While the component as described relates to a heat exchanger for a turbine engine, it should be appreciated that the component is not so limited and can be a component for a plurality if different systems, implementations or uses, particularly where a monolithic component having differing material properties is desirable.

Figure 1:
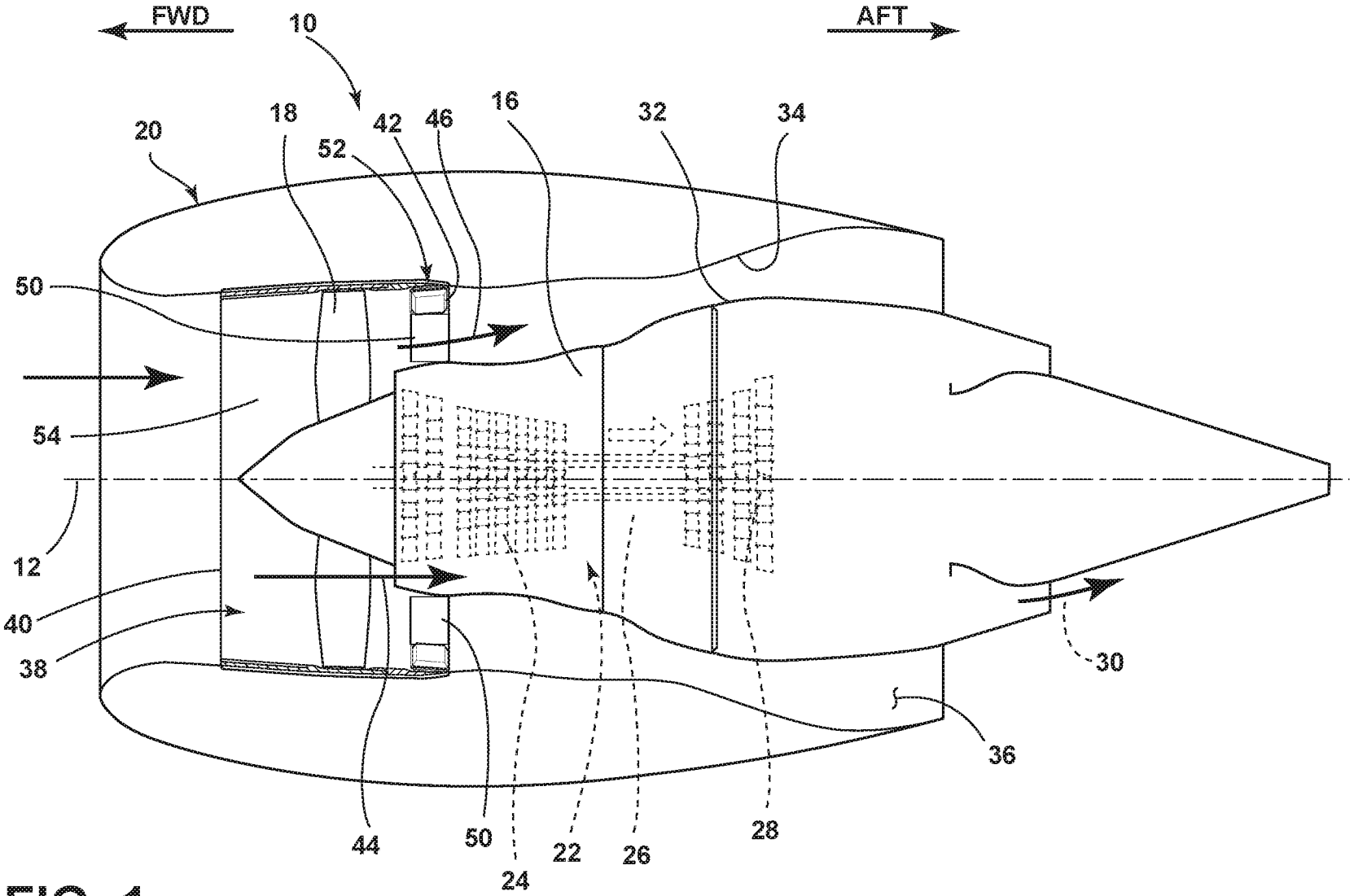
FIG. 1 is a schematic view of a turbine engine assembly with a casing with mounted heat exchangers in accordance with various aspects described herein.

Aspects of the heat exchanger have an improved design and result in improved heat transfer, while tailoring the heat exchanger to improve heat transfer at local desirable areas and improving strength at other local desirable areas. As the heat exchanger can be configured for use in an oil cooling system of an aircraft engine, FIG. 1 provides a brief explanation of the environment in which embodiments of the invention can be used. More specifically, FIG. 1 illustrates an exemplary turbine engine assembly 10 having a longitudinal axis defining an engine centerline 12. A turbine engine 16, a fan assembly 18, and a nacelle 20 can be included in the turbine engine assembly 10. The turbine engine 16 can include an engine core 22 having compressor(s) 24, combustion section 26, turbine(s) 28, and exhaust 30. An inner cowl 32 radially surrounds the engine core 22.

Portions of the nacelle 20 have been cut away for clarity. The nacelle 20 surrounds the turbine engine 16 including the inner cowl 32. In this manner, the nacelle 20 forms an outer cowl 34 radially surrounding the inner cowl 32. The outer cowl 34 is spaced from the inner cowl 32 to form an annular passage 36 between the inner cowl 32 and the outer cowl 34. The annular passage 36 characterizes, forms, or otherwise defines a nozzle and a generally forward-to-aft bypass airflow path. A fan casing assembly 38 having an annular forward casing 40 and an aft casing 42 can form a portion of the outer cowl 34 formed by the nacelle 20 or can be suspended from portions of the nacelle 20 via struts (not shown).

In operation, air flows through the fan assembly 18 and a first portion 44 of the airflow is channeled through compressor(s) 24 wherein the airflow is further compressed and delivered to the combustion section 26. Hot products of combustion (not shown) from the combustion section 26 are utilized to drive turbine(s) 28 and thus produce engine thrust. The annular passage 36 is utilized to bypass a second portion 46 of the airflow discharged from fan assembly 18 around engine core 22.

The turbine engine assembly 10 can pose unique thermal management challenges and a heat exchanger assembly 50 can be attached to the turbine engine assembly 10 to aid in the dissipation of heat through convective heat transfer via the second portion 46 of the airflow discharged from the fan assembly 18. In the exemplary embodiment, the heat exchanger assembly 50 can mount to and operably couple to an annular fan casing 52 having an annular peripheral wall 54 that forms an interior portion of the outer cowl 34. The heat exchanger provided at the fan casing 52, in one non-limiting example, can be a surface air-cooled oil cooler. As such, the heat exchanger 50 can be arranged to transfer heat from a heated fluid passing through the surface air-cooled oil cooler to air flowing through the bypass duct formed as the annular passage 36.

The fan casing 52, in non-limiting examples, can be the fan casing assembly 38, or the forward casing 40 or aft casing 42. It should be appreciated that the fan casing 52 can be any casing region, such that the casing encloses any structural hardware that is part of the annular duct defined by the fan casing assembly 38. Thus, the heat exchanger 50 can couple to the fan casing 52 at any axial position along the duct defined by the casing assembly 38. While the surface cooler 50 has been illustrated as being downstream of the fan assembly 18, and mounted to the aft portion of the fan casing 52, it is also contemplated that the heat exchanger 50 can alternatively be upstream from fan assembly 18, or at any position along the outer cowl 34 or the fan casing 52. Further still, while not illustrated, the heat exchanger 50 can be located adjacent the inner cowl 32. As such, it will be understood that the heat exchanger 50 can be positioned anywhere along the axial length of the annular passage 36.

Figure 2:
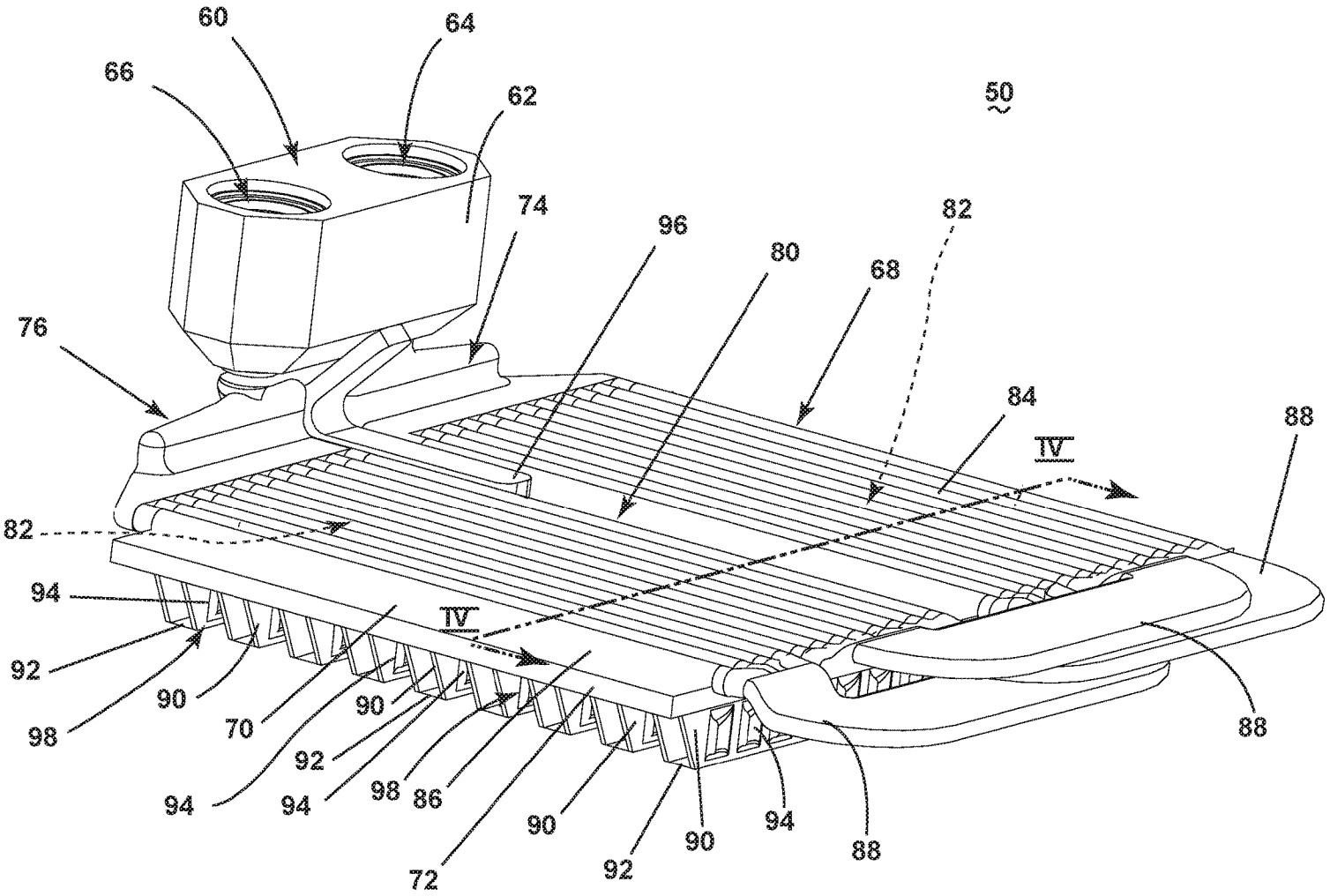
FIG. 2 is a perspective view of a heat exchanger that can be included in the turbine engine assembly of FIG. 1 in accordance with various aspects described herein.

In FIG. 2, the heat exchanger 50 is illustrated including a manifold 60 having a housing 62 encasing an inlet conduit 64 and an outlet conduit 66. An integral monolithic body 68 can be included in the heat exchanger 50 and defines a first surface 70 and a second surface 72. The monolithic body 68 can be configured for use in an aircraft engine or alternatively can be utilized in any suitable heat exchanger implementation.

A first manifold connection 74 and a second manifold connection 76 are included in the monolithic body 68. The first manifold connection 74 couples the manifold 60 to the monolithic body 68 at the inlet conduit 64 and the second manifold connection 76 couples the monolithic body 68 to the manifold 60 at the outlet conduit 66. It should be appreciated that while the inlet conduit 64 and outlet conduit 66 denote flow direction, the first and second manifold connections 74, 76 can be provided in any organization, to provide a flow to the monolithic body 68 in any direction. Furthermore, while illustrated as two separate manifold connections 74, 76 it will be understood that any number including a single manifold connection is contemplated.

A set of fluid passages 82 are included in the monolithic body 68 and the surface of such passages can at least partially define a shape of the first surface 74. The set of fluid passages 82 can be separated into a first set of fluid passages 84 aligned with the first manifold connection 74 and a second set of fluid passages 86 aligned with the second manifold connection 76. A channel 80 can be formed within the monolithic body 68 between the first and second sets of fluid passages 84, 86. Alternatively, it is contemplated that the monolithic body 68 can be formed without the channel 80.

A set of return manifolds 88 are included in the monolithic body 68 and can fluidly couple at least some of fluid passages 82, such as fluidly connecting the first set of fluid passages 84 with the second set of fluid passages 86. The exemplary heat exchanger 50 includes three return manifolds 88. It should be appreciated that any number of return manifolds, including one or more, can be utilized and that the manifold(s) can have any suitable shape and number of fluid couplings.

A set of fins 90 can also be included in the monolithic body 68. The set of fins 90 can extend from the second surface 72. In one non-limiting example, the second surface 72 can be flat to provide a uniform surface for the extension of the fins 90. The set of fins 90 can include one or more shrouds 92 provided on the fins 90. The shrouds 92 can extend fully or partially along the fins 90, between one or more adjacent fins 90. As such, any organization of shrouds 92 is contemplated. One or more louvers 94 can be formed in the fins 90. The louvers 94 can extend from either side of the fin 90. Additionally, it is contemplated that the louvers 94 are provided on the shrouds 92. Furthermore, it is contemplated that the fins 90 can include additional geometry, such as winglets or helical ribbing in non-limiting examples.

A support mount 96 can be operably coupled to the manifold 60, supporting the manifold 60 relative to the monolithic body 68. The support mount 96 can be formed as part of the monolithic body 68, or can be a separate element that couples to the monolithic body 68.

Figure 3:
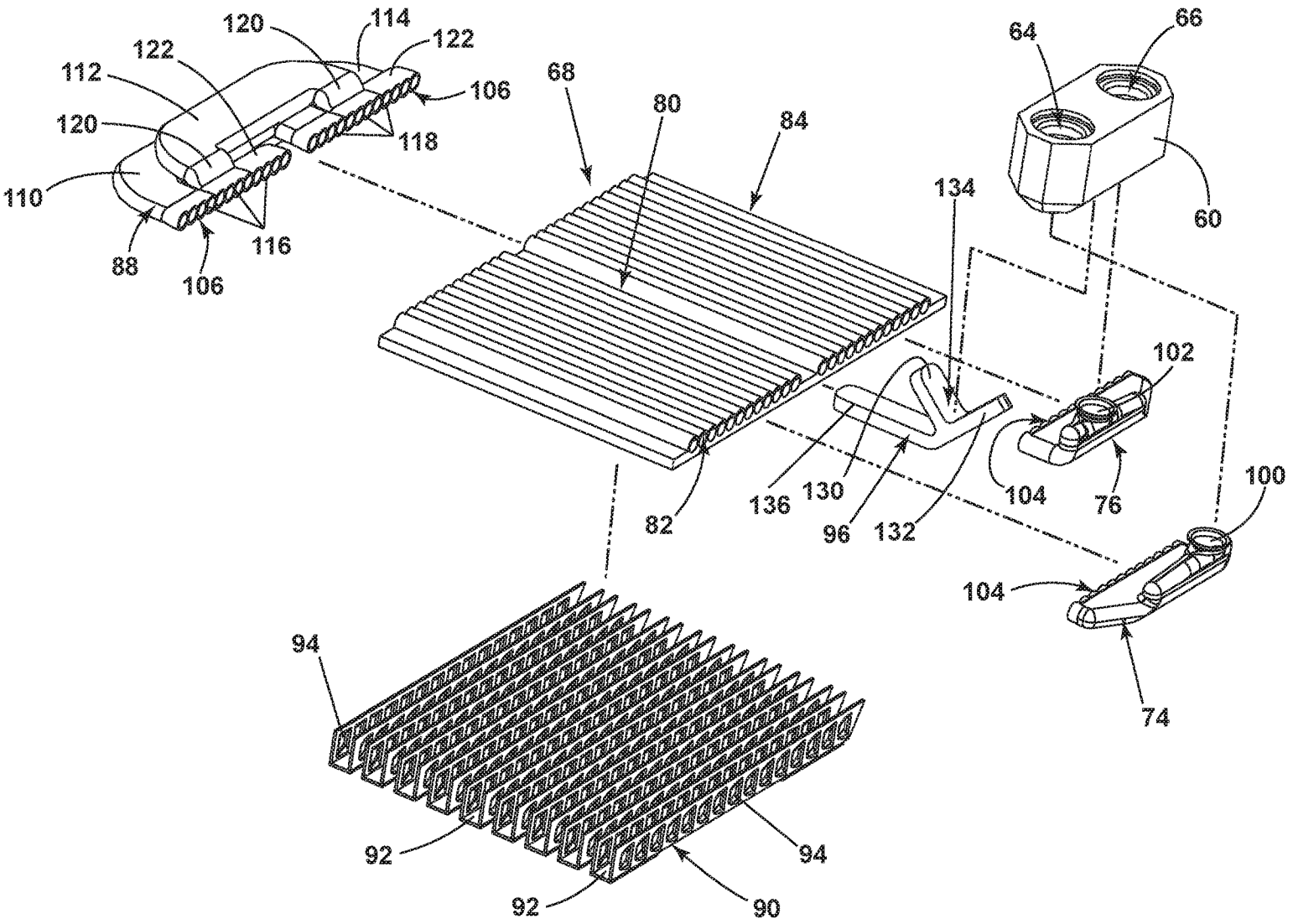
FIG. 3 is an exploded view of the heat exchanger of FIG. 2.

The exploded view in FIG. 3 better illustrates the elements of the heat exchanger 50. It should be appreciated that while illustrated as an exploded assembly, the integral monolithic body 68 includes the first and second manifold connections 74, 76, the set of fluid passages 82, the return manifolds 88, and the fins 90 as an integral monolithic element, and is only exploded to facilitate understanding of particular portions of the monolithic body 68.

As better illustrated in the faux exploded view, the first manifold connection 74 includes an inlet 100 adapted to couple via direct ionic metal deposition, for example, to the inlet conduit 64 of the manifold 60. An outlet 102 on the second manifold connection 76 is adapted to couple in similar manner to the outlet conduit 66 of the manifold 60. Alternatively, the inlet 100 can be provided on the second manifold connection 76 and the outlet 102 can be provided on the first manifold connection 74, defined by flow direction through the heat exchanger 50. A set of openings 104 can be formed in the first and second manifold connections 74, 76 complementary to the set of fluid passages 82 to fluidly couple the inlet 100 and outlet 102 to the set of fluid passages 82. Similarly, a set of openings 106 can be provided on the return manifolds 88 complementary to the set of fluid passages 82 to fluidly couple the return manifolds 88 to the fluid passages 82.

In the exemplary illustration, the return manifold 88 can be separated into a first return manifold 110, a second return manifold 112, and a third return manifold 114, with each return manifold 88 having an inlet end 116 and an outlet end 118. The first return manifold 110 can be substantially flat, while the second return manifold 112 can have a set of first slopes 120 and the third return manifold 114 can have a set of second slopes 122 extending in a direction opposite of the first slopes. The first slopes 120 can position the second return manifold 112 above the first return manifold 110 and the second slopes 122 can position the third return manifold 114 below the first return manifold 110. As such, the required longitudinal extent of the return manifolds 88 is minimized, saving space. Furthermore, the manifolds provide for maintaining a nearly uniform flow distribution and associated pressure drop. As shown, each inlet end 116 and outlet end 118 can include four openings 106, while number of openings 106 is contemplated, complementary to the number of fluid passages 82. In one alternative example, the monolithic body 68 can include two return manifolds 88, each having six openings at the inlet end 116 and the outlet end 118. It should be appreciated that the number of return manifolds 88 can be adapted to minimize pressure losses associated with turning a fluid between the first set of fluid passage 84 and the second set of fluid passages 86. Utilizing three manifolds 88 provides for greater uniformity of flow through the individual passages, which can be achieved by keeping the lengths of the manifolds 88 nearly equal. The maintained uniformity of flow helps to balance the flow for the passages, as well as the associated convective heat transfer for each passage by maintaining a nearly equal flow velocity through all fluid passages. Similarly, separating the return manifold 88 into multiple portions can provide for increased strength of the return manifolds 88. It should be appreciated that varying the number of return manifolds 88 can be used to balance minimizing pressure losses, flow efficiency, and integral strength for the particular heat exchanger 50.

Additionally, the number of passages in the set of fluid passages 82 can be balanced with volume or cross-sectional area of the individual fluid passages 82 to maximize heat transfer efficiency based upon necessary flow rates through the heat exchanger 50. The number of return manifolds 88 can be tailored to the needs of the set of fluid passages 82. The set of fluid passages 82 are illustrated as exemplary cylindrical passages, having a circular cross-sectional profile. A circular cross-sectional profile is preferable to hoop stress efficiencies for the fluid passages 82. Cylindrical tubes are most efficient for distributing stresses and permitting a reduced wall thickness to minimize overall component weight. Alternatively, any cross-sectional shape or area is contemplated. Such a cross-sectional shape or area can be adapted to maximize heat transfer from the fluid passing through the set of fluid passages 82. Such sizing can be based upon anticipated flow rates or local temperatures, in non-limiting examples.

A first arm 130 and a second arm 132 for the support mount 96 form a seat 134 for seating the manifold 60. A leg 136 extends from the seat 134. The leg 136 can be sized to fit within the channel 80 for mounting the manifold 60 to the monolithic body 68 or during formation of the monolithic body 68 relative to the support mount 96. While not shown, the first arm 130 or the second arm 132 can optionally include apertures for mechanically fastening the support mount 96 to the manifold 60 when not integral with the monolithic body 68.

Figure 4:
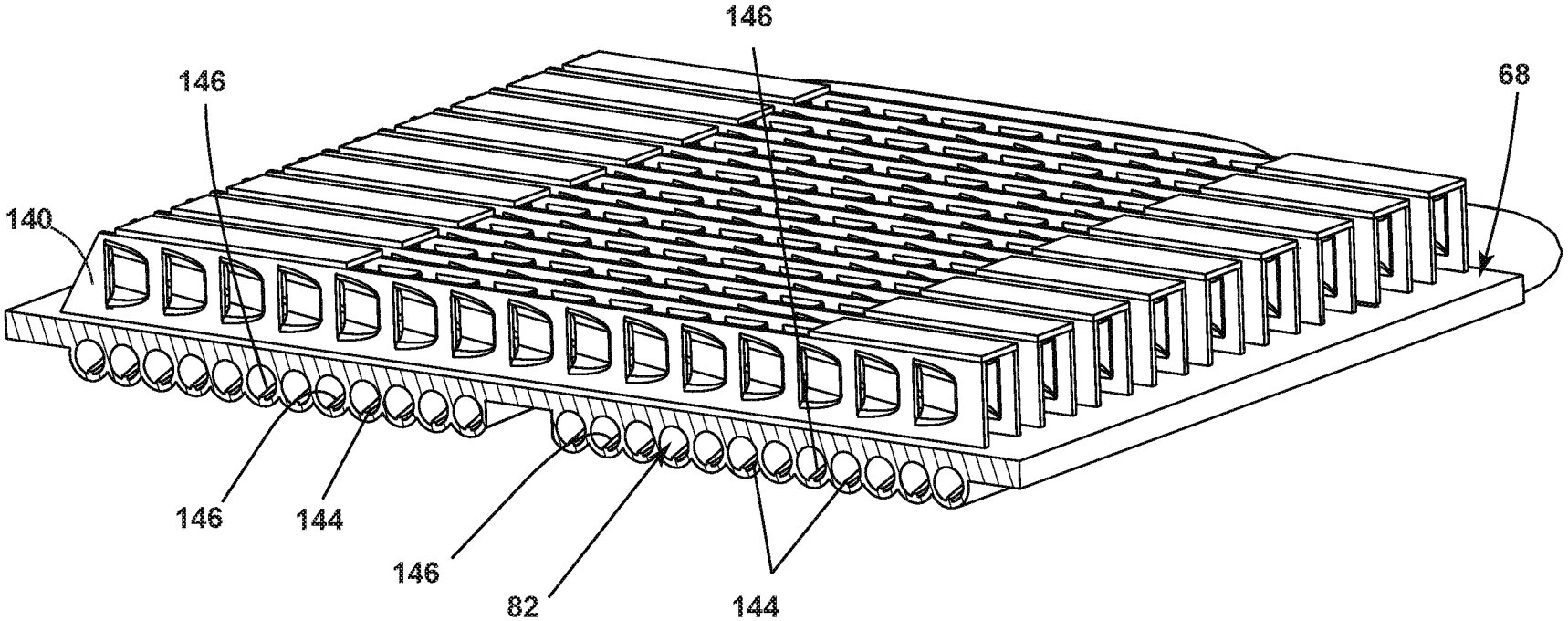
FIG. 4 is a cross-sectional view of the heat exchanger of FIG. 2 taken across section IV-IV of FIG. 2, illustrating thermal augmentation structures provided in the interior of fluid passages provided in the heat exchanger in accordance with various aspects described herein.

FIG. 4 shows a cross-sectional view of the set of fluid passages 82 taken across section IV-IV of FIG. 2. A set of winglets 140 can extend from one end of the fins 90. The winglets 140 can be formed as triangular extensions of the fins 90. The winglets 140, for example, can be positioned on the downstream end of the fins 90 to provide for increasing local turbulence downstream of the heat exchanger 50 generated by the fins 90, the louvers 94, or the shrouds 92. As shown, the louvers 94 are provided along nearly the entire length of the fins 90. In alternative examples, it is contemplated that the louvers 94 are provided only along a portion of the fins 90, or are organized to maximize heat transfer based upon turbulence and mixing flow patterns developed by adjacent fins 90, shrouds 92, or other louvers 94. Furthermore, additional or alternative augmentation features can be provided on the fins 90 along thermal exchange surfaces to create local turbulences and disruption of the boundary layer to increase convective heat transfer. Any such geometries or additional complex geometries facilitating improved convective heat transfer can be formed utilizing the electroforming methods as described herein, where traditional tooling would be expensive or impossible.

A thermal augmentation structure 144 can be formed in one or more of the set of fluid passages 82. The thermal augmentation structure 144 is shown as a set of semi-helical ribs 146. The ribs 146 can extend along at least a portion of a length of the fluid passages 82. Optionally, the ribs 146 can be formed as a single continuous helical rib extending along the length of the fluid passages 82. In additional alternative examples, the thermal augmentation structures can be chevrons, bumps, protrusions, protuberances, turbulators, or any similar structure intended to augment a flow passing through the fluid passages 82. Alternatively, it is contemplated that the thermal augmentation structures 144 can be negative features formed into the walls of the fluid passages 82, augmenting flow of fluid passing there through. While shown in all of the fluid passages 82, the thermal augmentation structure 144 can be formed on at least one fluid passage 82. Such thermal augmentation structures 144 can be adapted to improve thermal heat transfer within portions of the monolithic body 68, while balancing added weight to the heat exchanger 50. For example, the thermal augmentation structures can be provided in every-other fluid passage 82. In yet another example, the thermal augmentation structures 144 can be provided near the center of the monolithic body 68, where heat may gather more readily.

Figure 5:
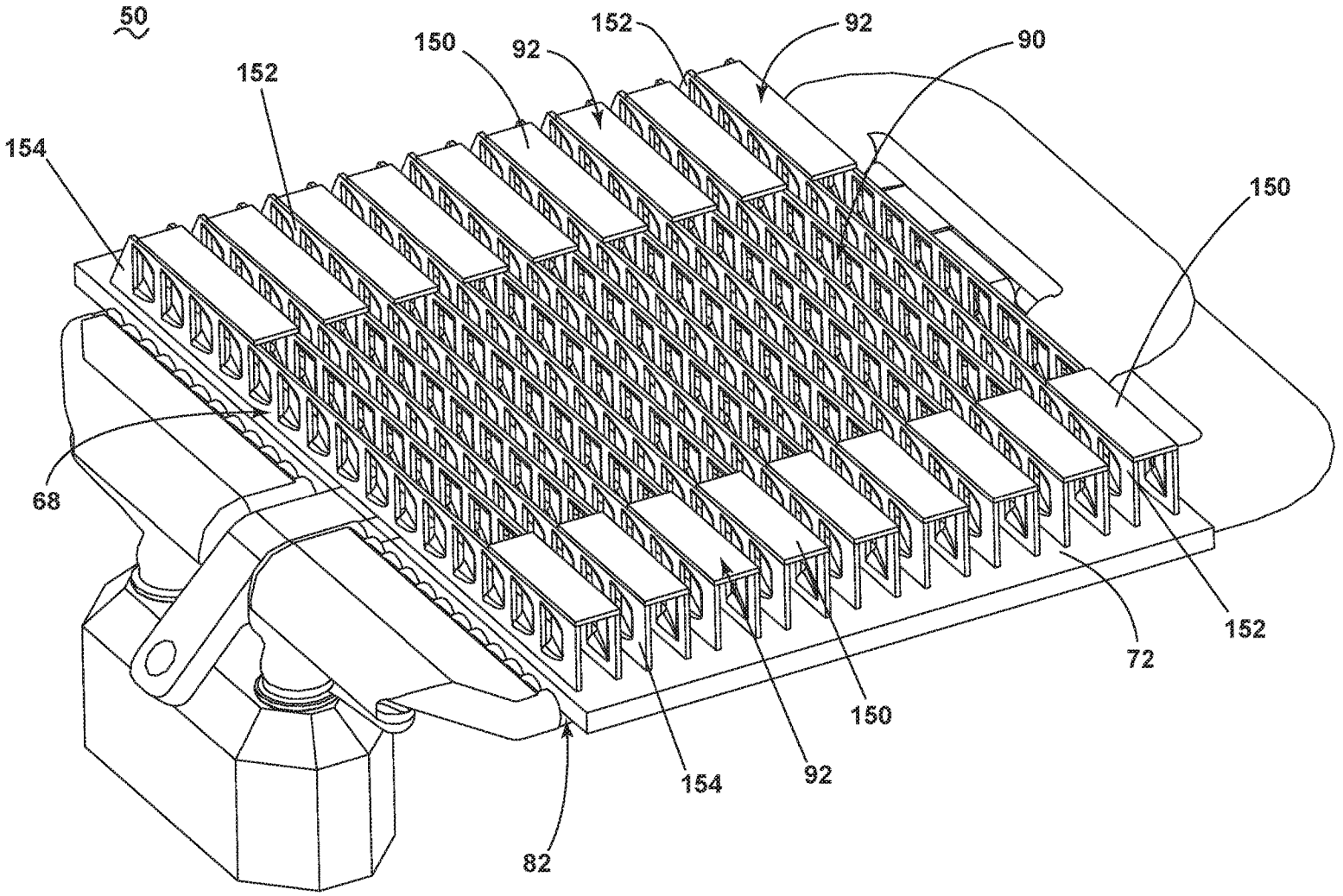
FIG. 5 is a perspective view of the bottom of the heat exchanger of FIG. 2 illustrating a set of fins.

Referring now to FIG. 5, a bottom view of the heat exchanger 50 better illustrates the fins 90 organized along the second surface 72. The fins 90 can extend orthogonal to the direction of the set of fluid passages 82. While eighteen fins 90 are shown, any number of fins 90 is contemplated. The spacing of the fins 90 can be adapted to maximize heat transfer and airflow through the fins 90.

The fins 90 can have a body 154. The shrouds 92 form a lateral portion 150 of the fin 90, and can be formed at the distal ends 152 of the body 154 of the fins 90, spaced from the second surface 72 and spanning two fins 90. The shrouds 92 provide for containing the flow of fluid through the fins 90, preventing the flow from escaping from the manifold body 68 through the distal ends 152 of the fins 90. Preventing the escape of the flow increases efficiency of the fins 90. While the shrouds 92 are shown as only covering a portion of the fins 90, it should be appreciated that the shrouds 92 can extend along any length of the fins 90 at any position, and can span multiple lateral fins 90 in any organization. Additionally, it is contemplated that the shrouds 92 couple to only a single fin 90. The fins 90 can be adapted to maximize efficiency while minimizing weight by utilizing multiple shrouds 92.

Figure 6:
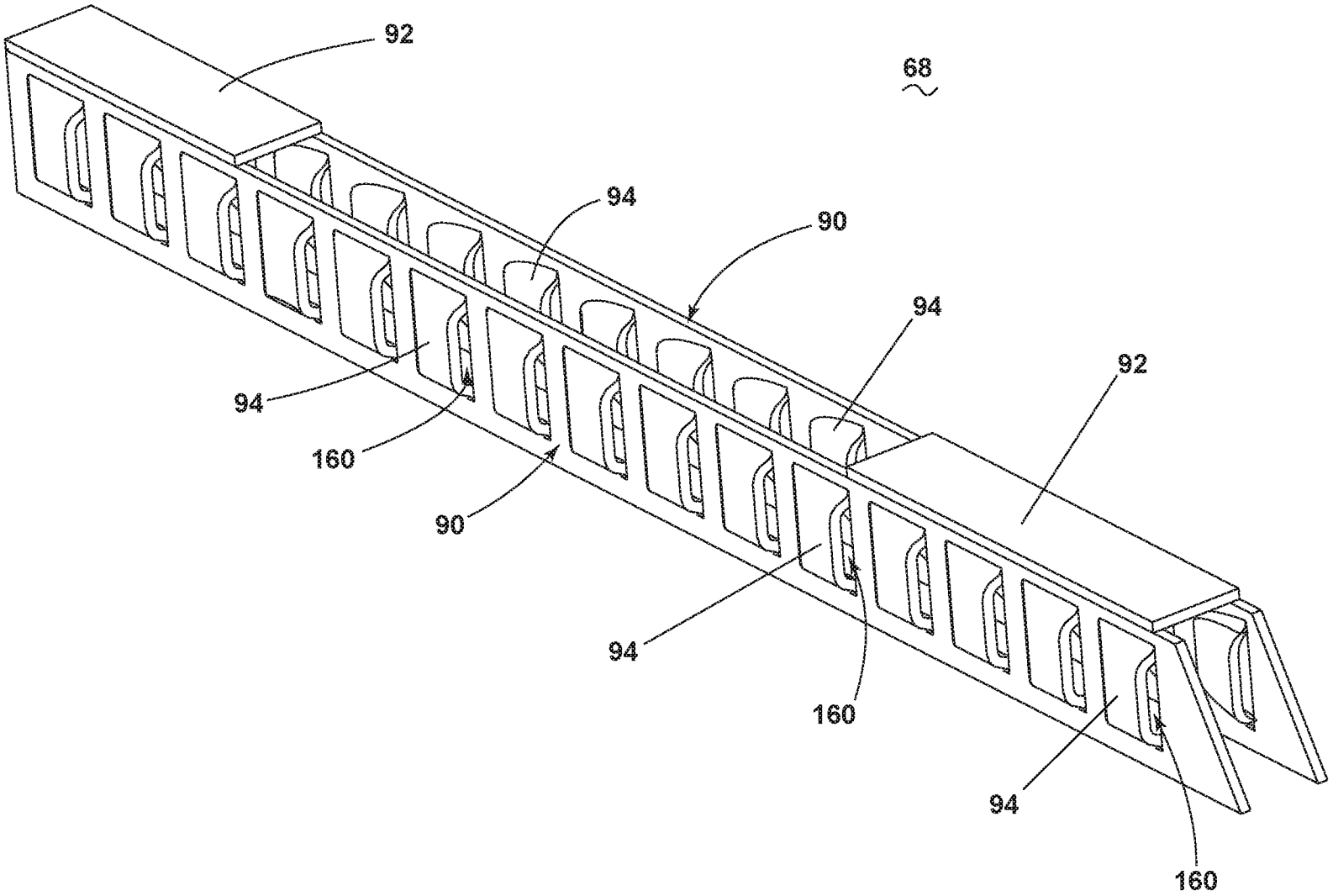
FIG. 6 is a perspective view of two fins of FIG. 5 having louvers and interconnected by shrouds in accordance with various aspects described herein.

Referring now to FIG. 6, two isolated fins 90 are illustrated, interconnected by two shrouds 92. While illustrated isolated from the monolithic body 68, it should be understood that the fins 90 are formed as part of the monolithic body 68, and are illustrated isolated therefrom to facilitate understanding of the fins 90.

An opening 160 can be formed in the louvers 94. The openings 160 can permit a flow of fluid to pass through the louvers 94 to another side of the fins 90. The openings 160 provide for forming a non-linear flow path for a fluid passing through the fins 90, improving heat transfer coefficients along the fins 90. The louvers 94 further provide increased surface area to improve heat transfer from the fins 90. While all of the louvers 94 as illustrated extend along one side of the fins 90 with the openings 160 all oriented toward the same side, it should be appreciated that the louvers 94 can extend on either side of the fins 90 or on both sides of the fins 90. In one non-limiting alternative example, the louvers 94 can be organized to move a flow back and forth on either side of the fins 90 through the openings 160.

In alternative examples, the fins 90 can include any shaped louver 94, with or without openings 160. The louvers 94 can be formed as alternative elements extending from the body 98, such as turbulators, bumps, or additional fins in non-limiting examples to affect a flow of fluid passing along the fins 90.

Figure 7:
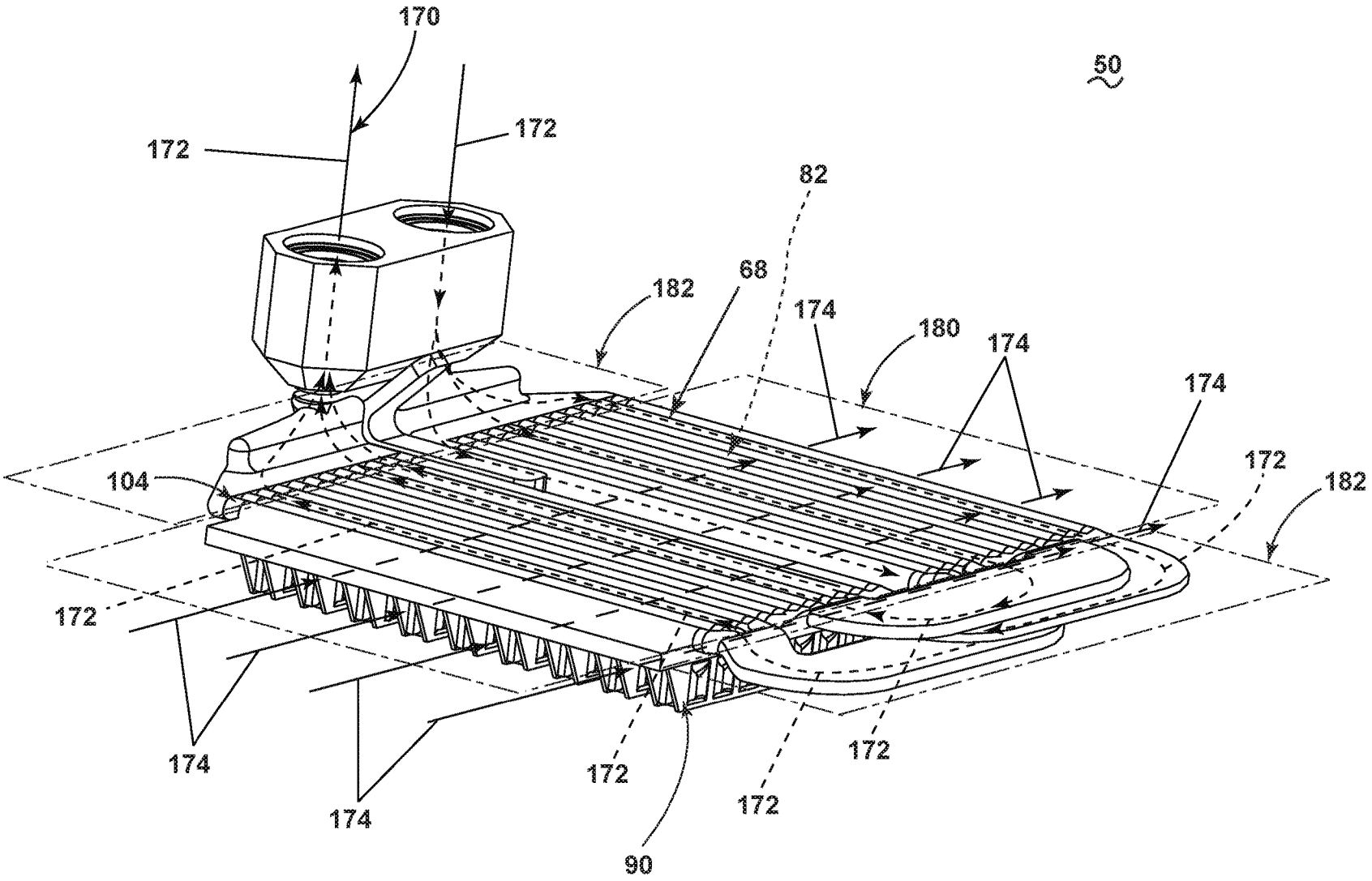
FIG. 7 is a perspective view of the heat exchanger of FIG. 2 illustrating a flow path through the heat exchanger as well as separating the heat exchanger into zones having different material properties in accordance with various aspects described herein.

FIG. 7 illustrates a flow path 170 defined through the heat exchanger 50. A heated flow of fluid 172 passing to the manifold 60 can enter the inlet conduit 64 and pass into the first manifold connection 74. The first manifold connection 74 can disperse the heated fluid 172 along a widened berth and pass through the openings 104 into the first set of fluid passages 84. The heated fluid 172 passes along the first set of fluid passages 84. The heat from the heated fluid 172 can transfer into the monolithic body 68 and into the fins 90. A flow of cool fluid 174, such as a flow of air passing through the bypass section of a turbine engine, can pass through the fins 90 and convectively cool the heat transferred to the fins 90 from the flow of fluid 172. While described as a heated fluid 172 and a cool fluid 174, the heated fluid 172 need not be a hot fluid and the cool fluid 174 need not be cold. The heated fluid 172 need only be warmer than the cool fluid 174 and the cool fluid 172 need only be colder than the heated fluid 172 to facilitate heat transfer by the heat exchanger 50.

The flow of heated fluid 172 exiting the first set of fluid passages 84 and passes into the return manifolds 88 and turns through the return manifolds to pass into the second set of fluid passages 86. Within the second set of fluid passages 86, additional heat within the heated flow of fluid 172 can pass into the fins 90, where the flow of fluid 174 passing through the fins 90 can further convectively remove heat transferred from the set of fluid passages 82. The heated flow of fluid 172, now cooled by the heat exchanger 50 via the fins 90, can pass into the second manifold connection 76. The second manifold passage 76 can provide for converging of the flow of fluid 172 to exhaust the flow of fluid 172 through the outlet conduit 66 in the manifold 60.

The monolithic body 68 can be separated into zones having different material properties. Exemplary material properties can include increased hardness resulting in increased tensile strength, or increased thermal conductivity. Alternative properties can include improved electrical conductivity, melting point, surface hardness, wear resistance, corrosion resistance, or rate of thermal expansion in non-limiting examples. Such exemplary properties can be resultant of electroforming the monolithic body 68 as described herein.

Figure 8:
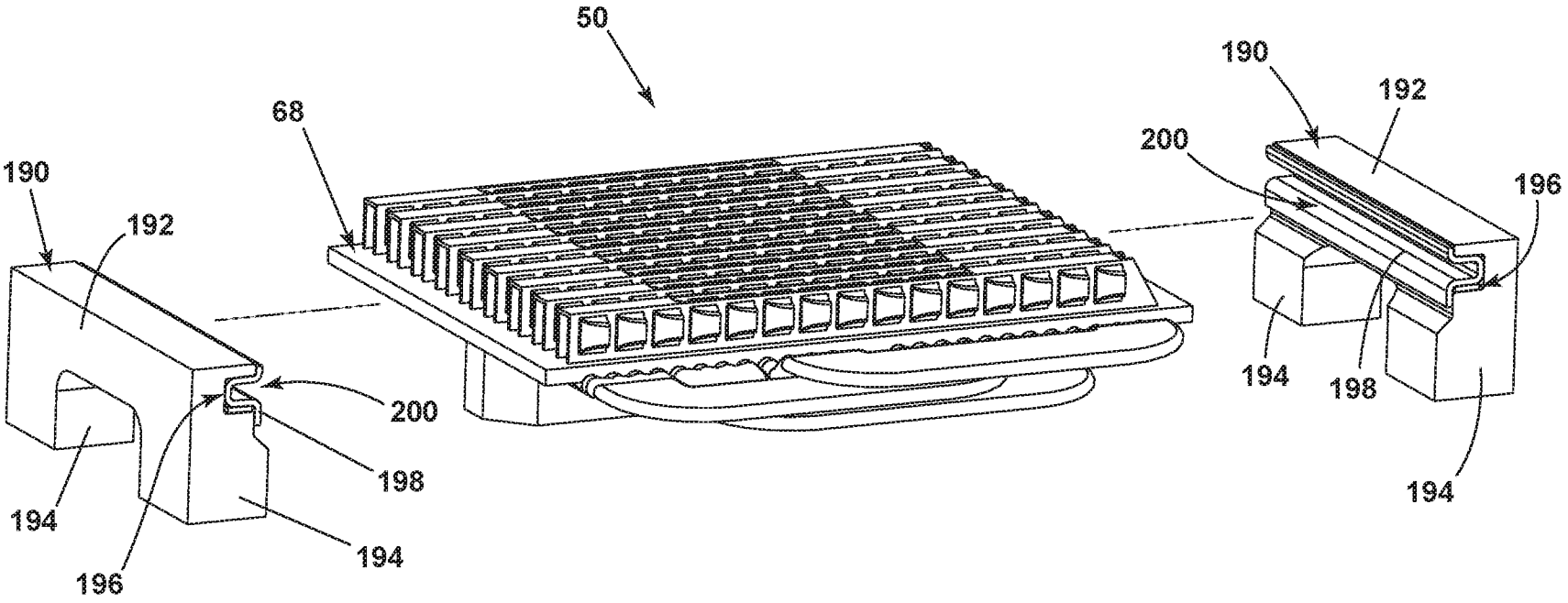
FIG. 8 is a perspective view of the heat exchanger of FIG. 2 with two mount brackets exploded about either sides of the heat exchanger for mounting the heat exchanger.

A first zone 180 of the heat exchanger 50 can be defined at the set of fluid passages 82 and the fins 90. The first zone 180 of the monolithic body 68 can have increased thermal conductivity as compared to second zones 182 along the monolithic body 68 adjacent the fins 90. The second zones 182 of the monolithic body 68 can be include the set of return manifold 88 and the first and second manifold connection 74, 76. The second zones 182 can include increased hardness or increased tensile strength compared to the first zone 180, the set of fluid passages 82, and the fins 90. Additionally, it is contemplated that the fluid passages 82 in eh first zone 180 can have increased tensile strength, with decreased thermal conductivity, permitting a greater amount of heat transfer toward the fins 90 for convective removal. Having a heat exchanger including multiple zones with differing material properties, such as the increased tensile strength or thermal conductivity, can provide for a heat exchanger that can be locally tailored maximize thermal conductivity at heat transfer regions, while maximizing component strength at other areas requiring increased strength. Furthermore, utilizing the zones can maximize efficiency while balancing engine weight. The improved thermal conductivity can improve heat exchanger efficiency, while improved strength can minimize required maintenance and increase component lifetime. FIG. 8 illustrates a set of mounting brackets 190 exploded from the heat exchanger 50. The mounting brackets 190 include a body 192 having a pair of posts 194 and a groove 196. A wear resistant material 198 can be provided in the groove 196 defining a slot 200. The wear resistant material 198, in one non-limiting example, can be polyether ether ketone (PEEK). Similarly, the wear resistant material 198 can be vibration resistant, to dampen any operational vibrations transferred to or from the heat exchanger 50 during operation. The slot 200 can be shaped to receive the monolithic body 68 to secure the heat exchanger 50 to the mounting brackets 190. During assembly, the mounting brackets 190 can mount to the fan casing assembly 38 of FIG. 1, in one non-limiting example, utilizing one or more fasteners.

Figure 9:
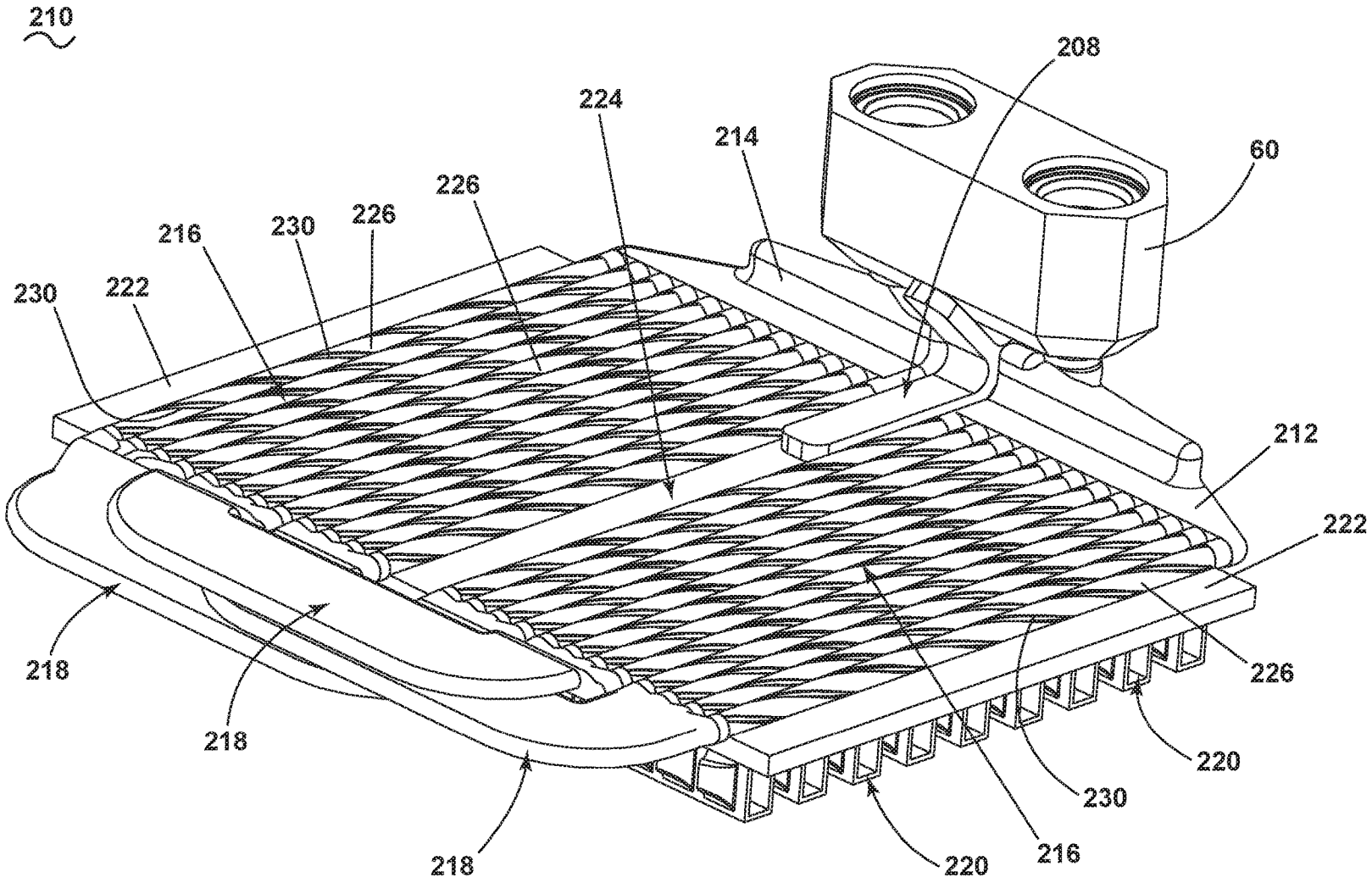
FIG. 9 is a perspective view of a sacrificial mold mounted to machined elements used to form the heat exchanger of FIG. 2.

Referring to FIG. 9, an assembly of stereolithography components 210 can be mounted to machined parts including a base plate 222 and the manifold 60. The stereolithography assembly mounted to the base plate 222 and manifold 60 can be used in electroforming the heat exchanger 50 of FIGS. 1-8.

The stereolithography component assembly 210 includes a first manifold connection structure 212, a second manifold connection structure 214, a set of fluid passage channel structures 216, a set of return manifold structures 218, and a set of fin structures 220 adapted to form the monolithic body 68 including the first manifold connection 74, the second manifold connection 76, the set of fluid passages 82, the return manifolds 88, and the fins 90 of FIG. 2, respectively. It is contemplated that at least some of the stereolithography component assembly 210 can be formed as a single integral element, or can be combined by integrating the separate structures. Optionally, the stereolithography component assembly 210 can include a support mount structure 208, adapted to form the support mount 96 as part of the monolithic body 68. In one non-limiting example, the stereolithography component assembly 210 can be additively manufactured plastic forms that act as sacrificial molds.

The base plate 222 can couple the stereolithography component assembly 210. The base plate 222 can be made of aluminum, in one non-limiting example, while additional metallic materials are contemplated such as nickel. A plate groove 224 can be formed in the base plate 222 between the set of fluid passage channel structure 216 adapted to receive the support mount structure 208.

The first and second manifold connection structures 212, 214 can be insert-molded to the manifold 60 and joined by the over-molding of deposited metal on the surface of the combined parts during eventual electroforming processes. It should be understood that the manifold 60 is not part of the stereolithography component assembly 210, and can be formed of machined aluminum in one non-limiting example and coupled to the stereolithographic component assembly 210 at the first and second manifold connection structure 212, 214. Alternatively, it is contemplated that the manifold 60 can be used to form part of the stereolithography component assembly 210.

Figure 10:
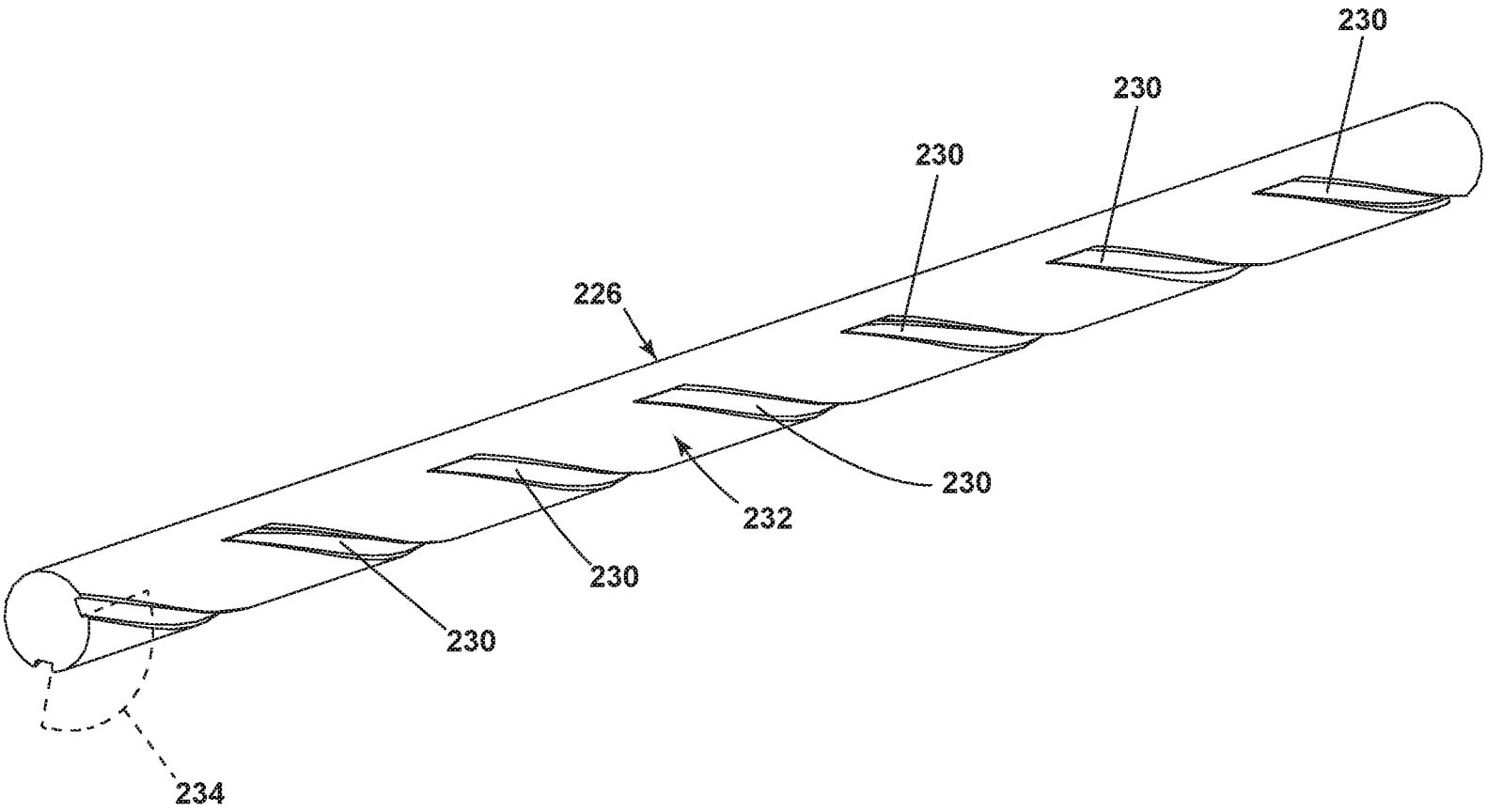
FIG. 10 is a perspective view of one rod having a set of grooves utilized in forming the fluid passages with the thermal augmentation structures of FIGS. 2 and 4, in accordance with various aspects described herein.

A set of rods 226 can form the set of fluid passage channel structures 216. The set of rods 226 can mount between the first and second manifold connection structures 212, 214 and the set of return manifold structures 218, positioned on the base plate 222. The rods 226 can include grooves 230 at least partially arranged about the rods 226. Referring to FIG. 10, the grooves 230 can be arranged in a helical manner only on a portion 232 of the rods 226. The portion 232 can cover, for example, the bottom third 234 of the rods 226. The helical grooves 230 can be adapted to form the thermal augmentation structures 144 of FIG. 4. Alternative grooves can be channels, chevrons, divots, or any structure having any geometry formed into the rods 226, covering any portion of the rods 226. Alternatively, it is contemplated that the grooves 230 can be positive elements, extending outward from the rods 226 as opposed to into the rods 226. As such, the resultant thermal augmentation structures 144 of FIG. 4 would be negative features formed into the walls of the set of fluid passages 82.

Figure 11:
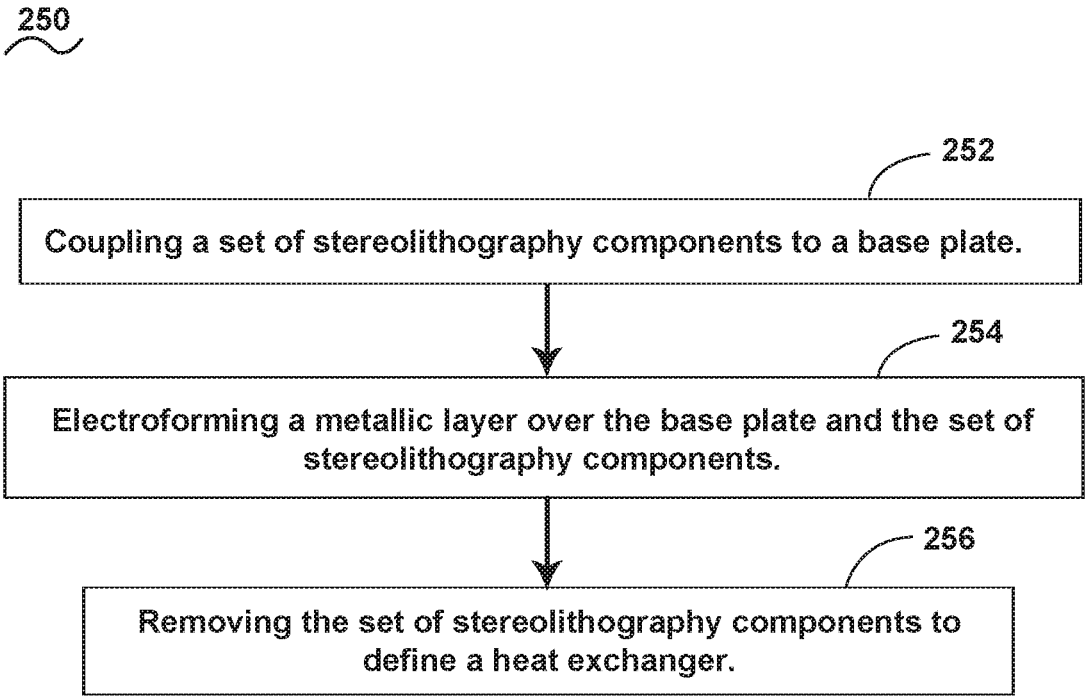
FIG. 11 is a flow chart illustrating a method of forming the heat exchanger of FIG. 2.

Referring to FIG. 11, a method 250 of forming the heat exchanger 50 is described utilizing the stereolithography components 210, base plate 222, and manifold 60. The method can include providing a base plate, such as the base plate 222. At 252, the method 250 can include coupling a set of stereolithography components to the base plate where the set of stereolithography components include a set of return manifolds and a set of fluid passage channel structures. The base plate, the set of return manifolds, and the set of fluid passage channel structures can be the base plate 222, the set of return manifolds 218, and the set of fluid passage channel structures 216 as described in FIG. 9. Additionally, the set of stereolithography components can further include a set of fin structures, such as the set of fin structures 220 of FIG. 9. The set of stereolithography components in the method 250 can further couple to a machined manifold section, such as the manifold 60 as described herein. In one example, the manifold section can be made of machined aluminum.

At 254, the method 250 can further include electroforming a metallic layer over exposed surfaces of the base plate 222 or the manifold 60, and any other components such as the outer surfaces of the set of stereolithography components. It is contemplated that prior to electroforming, the exposed surface can be pre-treated to clean the exposed metal surfaces for deposition of charged metal ions. An initial metal layer can be formed over the exposed surfaces and the stereolithography components, in order to facilitate electroforming, such as using electroless plating as a chemical process prior to electroforming. Electroforming, in one non-limiting example, can be additive manufacturing such as electrodeposition. One alternative example can include electroplating. Such electrodeposition can be used to form the metallic layer from an aluminum alloy, while other alloys are contemplated. In one non-limiting example, the metallic layer can be made from aluminum (Al) and manganese (Mn), such as $Al_6Mn$. Utilizing electrodeposition to control the amount of Mn included in the metallic layer can provide for forming zones having different material properties, such as the zones 180, 182 of FIG. 7. For example, a lesser amount of Mn can result in an alloy having lesser hardness while having increased thermal conductivity as opposed to a portion with increased hardness. Alternatively, a greater concentration of Mn can provide a significantly higher hardness, while having minimized thermal conductivity. The Mn concentration during electroforming of the heat exchanger 50 can provide for increased hardness for a zone, such as the first zone 180 of FIG. 7, or alternatively, decreased hardness while having improved thermal conductivity, such as the second zones 182 of FIG. 7, based upon the concentration of Mn. As such, the zones can have differing material properties such as increased hardness resulting in improved tensile strength, or increase thermal conductivity. In alternative examples, electrodeposition can be used in electroforming the metallic layer to have additional material properties such as increased or decreased electric conductivity, melting point, or rate of thermal expansion in non-limiting examples. The electroformed metallic layer, in one non-limiting example, can have a wall thickness between 0.030 and 0.050 inches, being thinner than typical wall thicknesses for typical heat exchanger assemblies.

At 256, the method 250 can further include removing the set of stereolithography components to define the heat exchanger having an integral monolithic body with a set of fluid passages, at least some of which are fluidly coupled via the set of return manifolds. Removal of the stereolithography components, in one non-limiting example, can be accomplished through heat purging or chemical etching.

Figure 12:
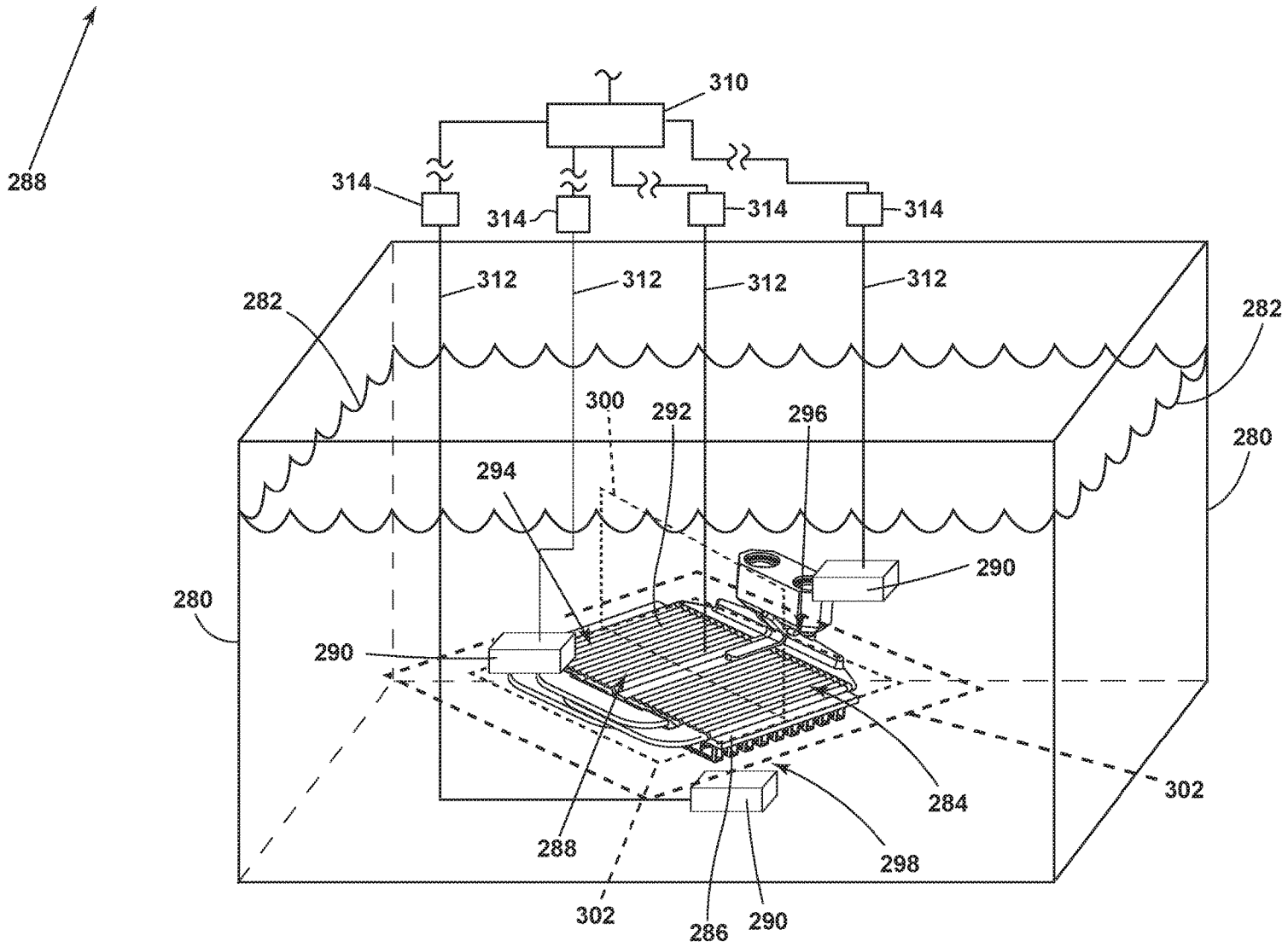
FIG. 12 is a perspective view of an exemplary schematic bath tank for electroforming a component in the form of the heat exchanger of FIG. 2 utilizing multiple cathodes in accordance with various aspects described herein.

Referring now to FIG. 12, an exemplary bath tank 280 carries a single metal constituent solution 282. The single metal constituent solution 282, in one non-limiting example, can include aluminum alloy carrying manganese ions. In one alternative, non-limiting example, the single metal constituent solution 282 can include nickel alloy carrying alloying metal ions. A stereolithography component 284 is provided in the bath tank 280. In one example, the stereolithography component 284 can be representative of the stereolithography component assembly 210 used to form the monolithic body 68 as described herein. The stereolithography component 284 can couple to a base plate 286 made of aluminum, such as the base plate 222 of FIG. 9 as described. The stereolithography component 284 can include an outer surface 288, similar to the outer surface 270 of FIG. 14 described herein, while the base plate 286 can have exposed surfaces that are not covered by the stereolithography component 284.

Three anodes 290 are spaced from a cathode 292 are provided in the bath tank 280. The anodes 290 can be sacrificial anodes or an inert anode. While three anodes are shown, the bath tank 280 can include any number of anodes 290, including one or more. The stereolithography component 284 can form the cathode 292, having electrically conductive material. Where the sacrificial molds of the component 284 are minimally or non-conductive, a conductive spray or similar treatment can be provided to the outer surface 288 to facilitate formation of the cathode 292. While illustrated as one cathode 292, it should be appreciated that one or more cathodes are contemplated.

A first barrier shield 300, which can be made of plastic in one non-limiting example, can be positioned above the stereolithography component 284, separating the stereolithography component 284 into a first zone 294 on one side of the first barrier shield 300 and a second zone 296 on the other side of the first barrier shield 300. A second barrier shield 302 can be positioned around the stereolithography component 284, in a belt-type position, separating the first and second zones 294, 296 at the top of the stereolithography component from a third zone 298 underneath the stereolithography component 284. The barrier shields 300, 302 are non-conductive elements. One anode 290 can be placed in each zone 294, 296, 298, being spaced from the stereolithography component 284. Separating the anodes 290 with the barrier shields 300, 302 can be used to control the local concentration of alloying ions in the metal constituent solution 282, by isolating the electrolyte.

A controller 310, which can include a power supply, can electrically couple to the anodes 290 and the cathode 292 by electrical conduits 312 to form a circuit via the conductive metal constituent solution 282. Optionally, a switch 314 or sub-controller can be included along the electrical conduits 312, between the controller 310 and the anodes 290 and cathode 292. The switches 314 can selectively power the individual anodes 290, effectively separating the controller 310 into multiple power supplies extending to the multiple anodes 290. Alternatively, it is contemplated that the switches 314 form individual, multiple power supplies 314 that are communicatively coupled to the controller 310 for providing individual power to each of the anodes 290 and cathode 292, as opposed to utilizing a common source.

During operation, a current can be supplied from the anodes 290 to the cathode 292 to electroform a monolithic body at the stereolithography component 284 and the base plate 286. During supply of the current, aluminum and manganese from the single metal constituent solution 282 form a metallic layer, such as the metallic layer 274 described in FIGS. 15 and 16, to form the monolithic body over the stereolithography component 284.

The placement of the separate anodes 290 within the separate zones 294, 296, 298 can provide for particularly controlling formation of the monolithic body. For example, utilizing the controller 310 or the switches 314 to selectively operate the anodes 290 can be used to determine the concentration and formation of the monolithic body locally, which can be used to locally determine material properties for monolithic body.

Figure 13:
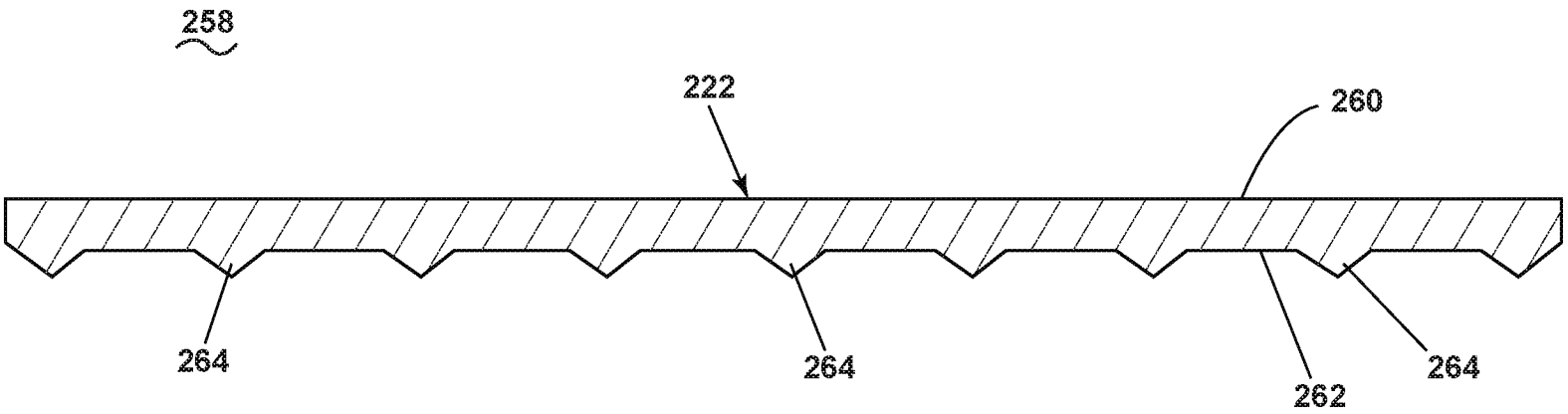
FIG. 13 is a schematic section view of a base plate utilized in the method of FIG. 11.
Figure 14:
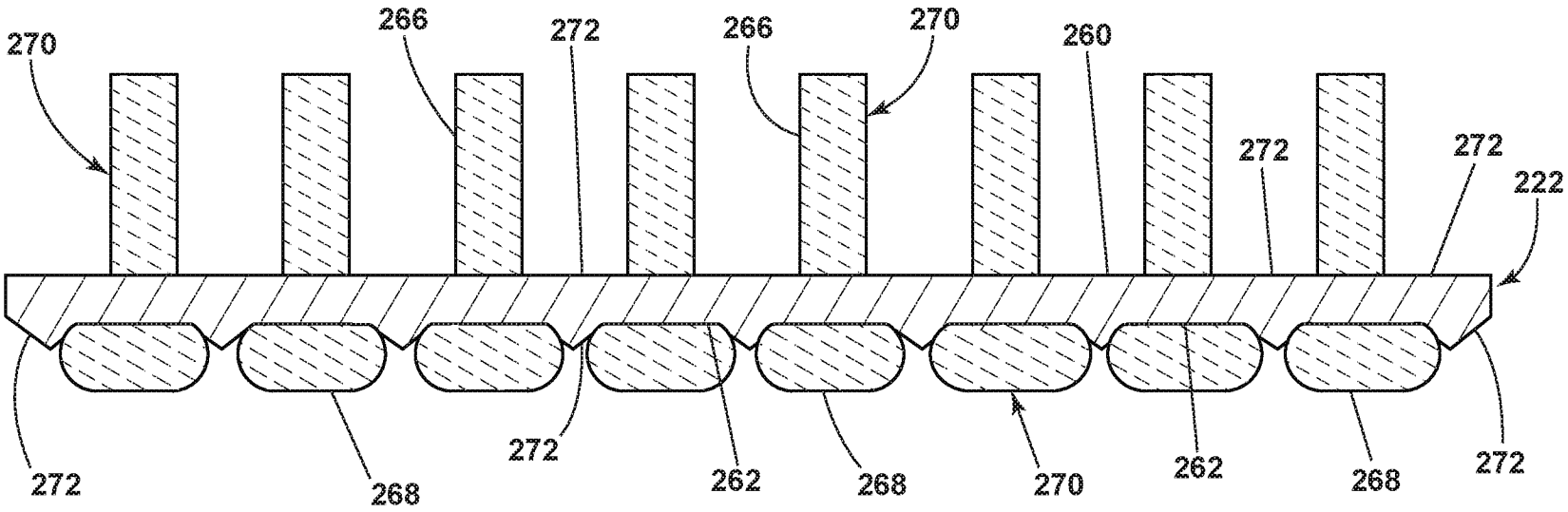
FIG. 14 is a schematic section view of the base plate of FIG. 13 with sacrificial mold forms coupled to the base plate.

FIG. 13 illustrates one step in forming a monolithic component, such as that of FIG. 12, and can be in the exemplary form of the heat exchanger as described herein, while it should be understood that the method could be utilizing in forming any component having differing material properties and is not limited to the heat exchanger as described. A schematic portion of an electrodeposition assembly 258 can include the base plate 222 or any suitable base made of metallic material such as machined aluminum in one non-limiting example. The base plate 222 can have a first side 260 that can be flat and a second side 262 with a set of extensions 264. Referring now to FIG. 14, a set of 3D printed sacrificial mold forms, illustrated in dashed line, can couple to the base plate 222. A set of sacrificial fin forms 266 can be arranged along the first flat side 260 and a set of fluid passage forms 268 can be arranged along the second side 262 between the extensions 264. The sacrificial molds 266, 268 in combination with exposed portions of the base plate 222 can form an outer surface 270. It should be appreciated that the sacrificial molds 266, 268 can cover only a portion of the base plate 222, leaving exposed surfaces 272 for the base plate 222. The sacrificial molds 266, 268 can be formed of plastic, in one non-limiting example, by additive manufacturing. The sacrificial mold forms can be made by any suitable additive manufacturing or 3D printing method, or can be made by any other suitable method, such as molding or extrusion. In an example where a component formed by electrodeposition is a complex component, it may be desirable to form the sacrificial mold forms by 3D printing to achieve the complex formations suitable in forming the complex component.

Figure 15:
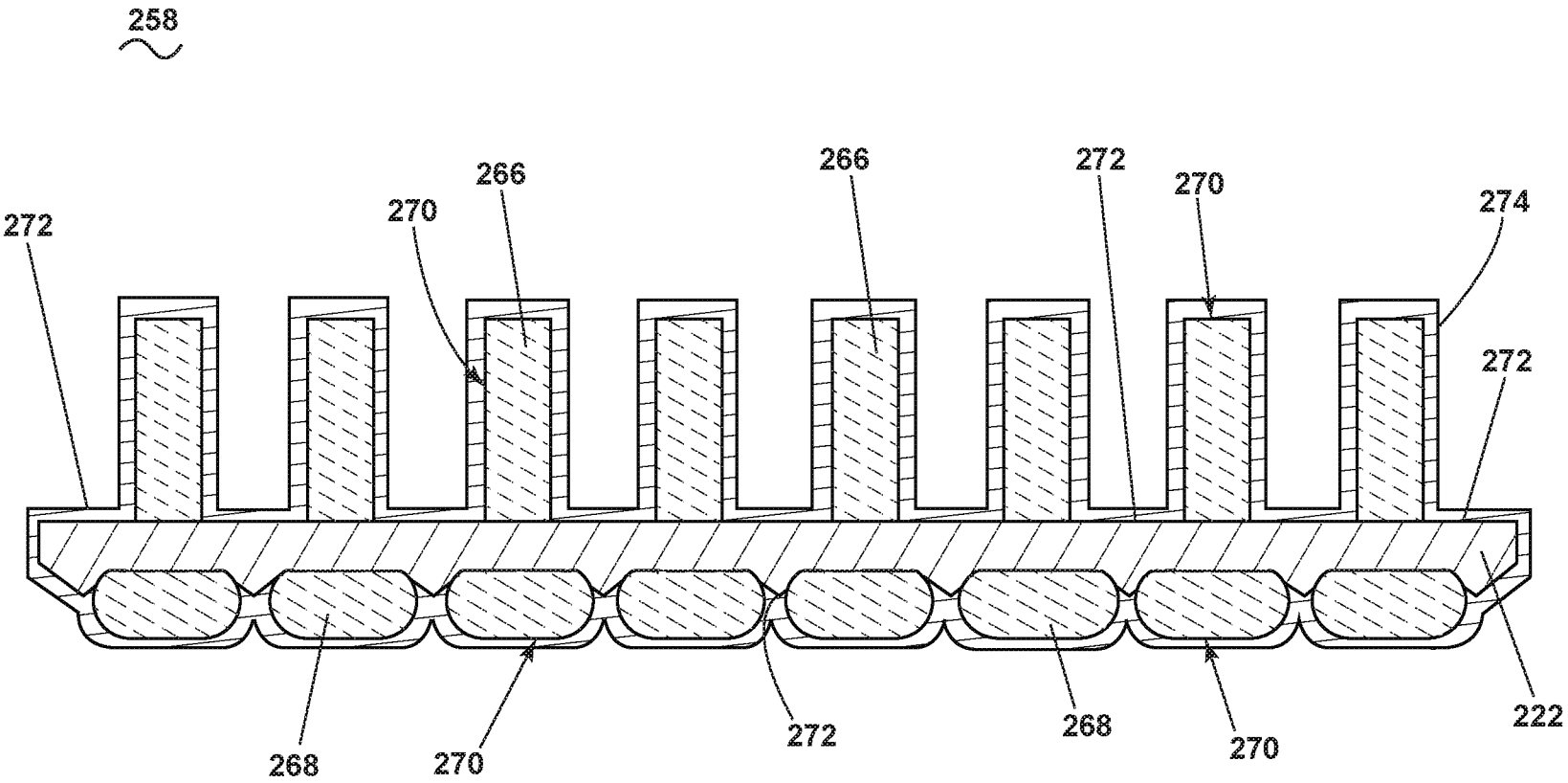
FIG. 15 is a schematic section view of the base plate and sacrificial mold forms of FIG. 14 including a metallic layer electroformed over the base plate and sacrificial mold forms to form a monolithic body.

In FIG. 15, a metallic layer 274 can be formed around the outer surface 270 of the plastic forms 266, 268 and the exposed surfaces 272 of the base plate 222. While the metallic layer 274 has been illustrated as a separately defined layer, it will be understood that the metallic layer 274 can be formed by electrodeposition and can form a monolithic or integral part of the component. The metallic layer 274 can be formed utilizing local anodes, such as those of FIG. 12, while the exposed metallic portions of the electrodeposition assembly 258 can form the cathode. In order to facilitate formation of the metallic layer 274 around the sacrificial molds 266, 268, a metallic spray of similar material can be applied to the sacrificial molds 266, 268. The metallic layer 274 can be made of an aluminum alloy in one non-limiting example.

Figure 16:
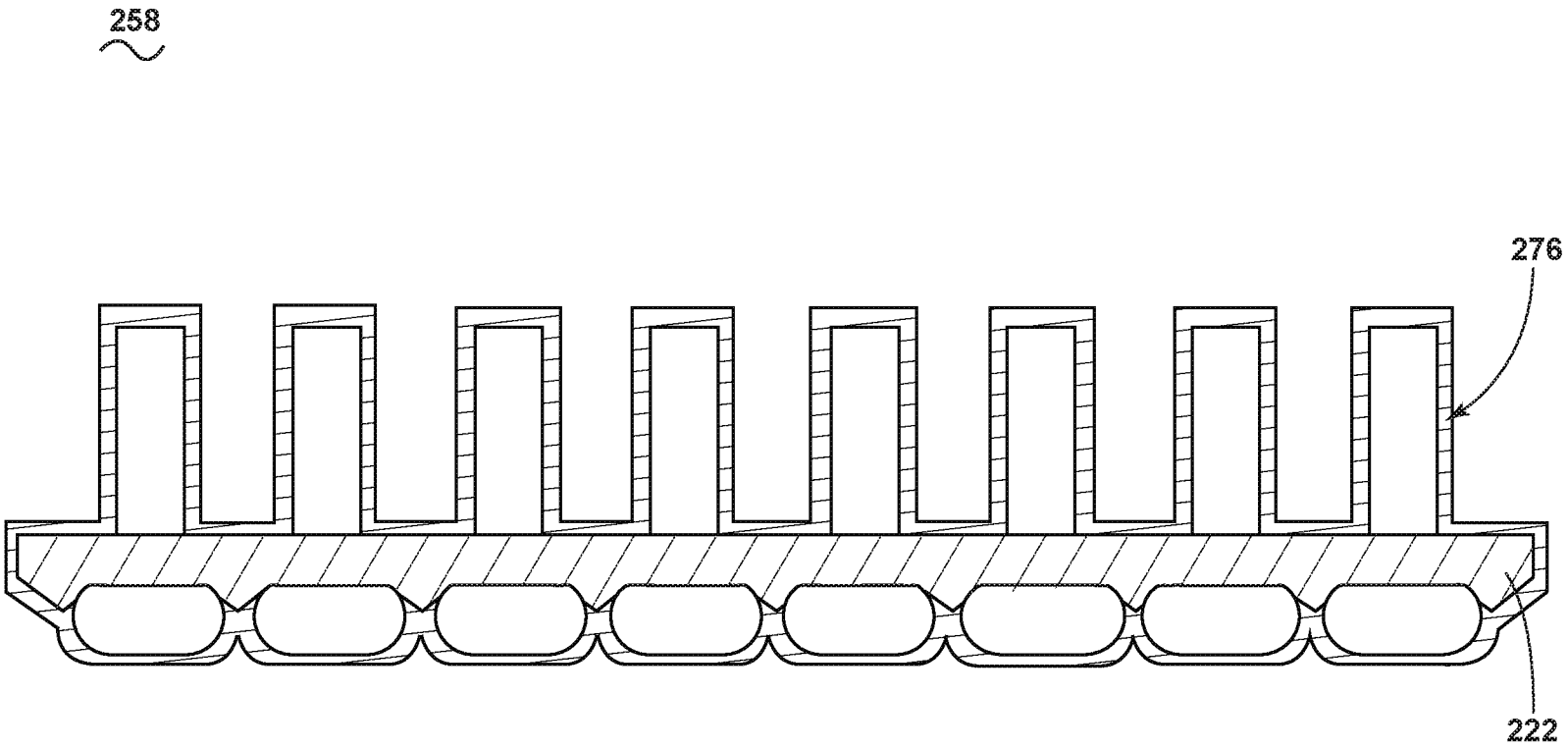
FIG. 16 is a schematic section view of the monolithic body of FIG. 15 having the sacrificial mold forms removed.

In FIG. 16, the sacrificial molds 266, 268 have been removed to form a monolithic body 276 around the base plate 222, which can be the monolithic body 68 as described herein. The removed sacrificial molds 266, 268 can be removed through any suitable method, such as heat purging or chemical etching. The removed sacrificial fin forms 266, in a first non-limiting example, can form the fins 90 of FIG. 2 and the removed sacrificial passage forms 268, in another non-limiting example, can form the set of fluid passages 82 of FIG. 2.

Figure 17:
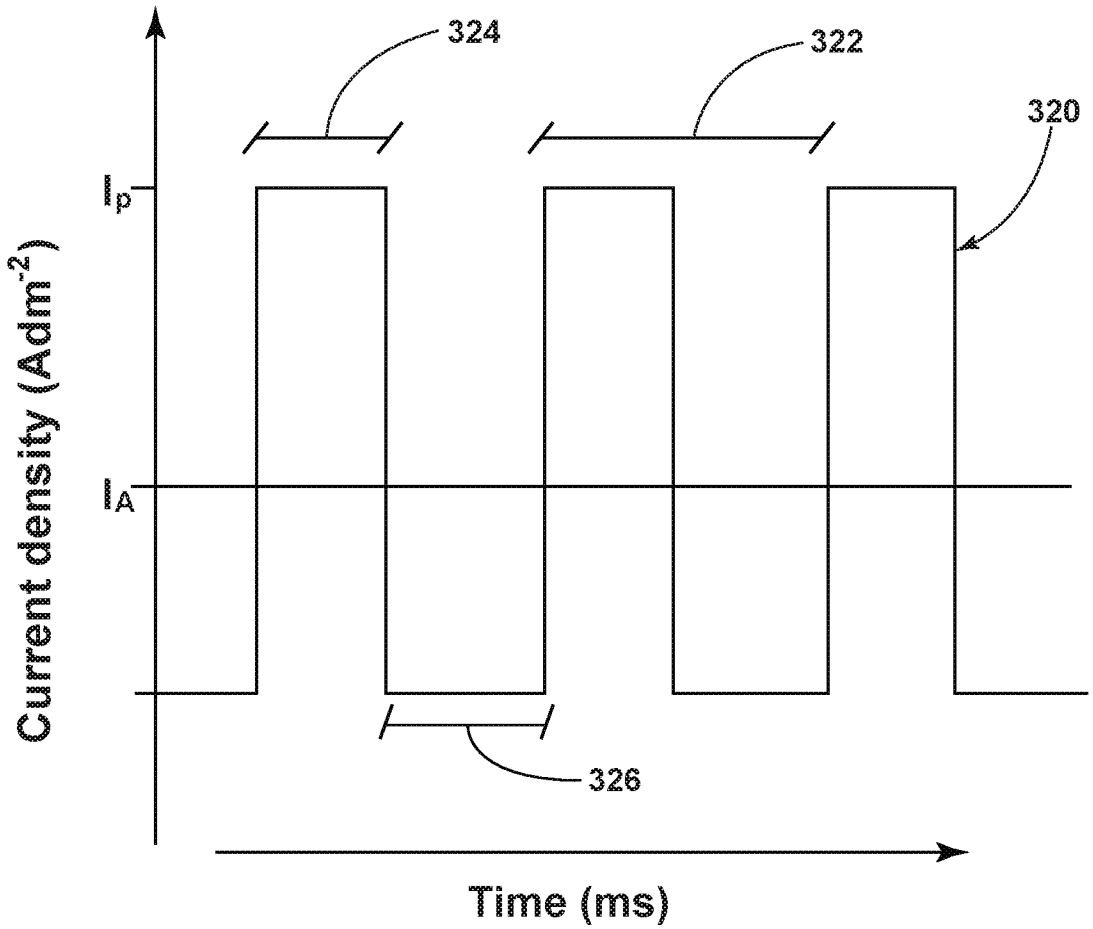
FIG. 17 is a plot graph illustrating a pulsed current to form the component of FIG. 16.

Referring now to FIG. 17, a plot graph 320 illustrates a pulsed current waveform, having a periodic cycle 322 including an on period 324 and an off period 326. With the pulsed current, a current can be supplied at a predetermined current density to one or more cathodes for a period of time during the on period 324, and then the current is stopped for the off period 326 for a predetermined amount of time. The periodic cycle 322 of supply and termination of current can be repeated for a predetermined period. The periodic cycle 322 can be representative of a supply of current to one or more of the anodes 290 of FIG. 12 in electroforming the monolithic component. With the pulsed current waveform, multiple anodes, such as the anodes 290 of FIG. 12, can be used adjacent various zones, such as the zones 294, 296, 298 of FIG. 12. The use of multiple anodes 290 provides for a waveform relative to the common cathode potential.

Figure 18:
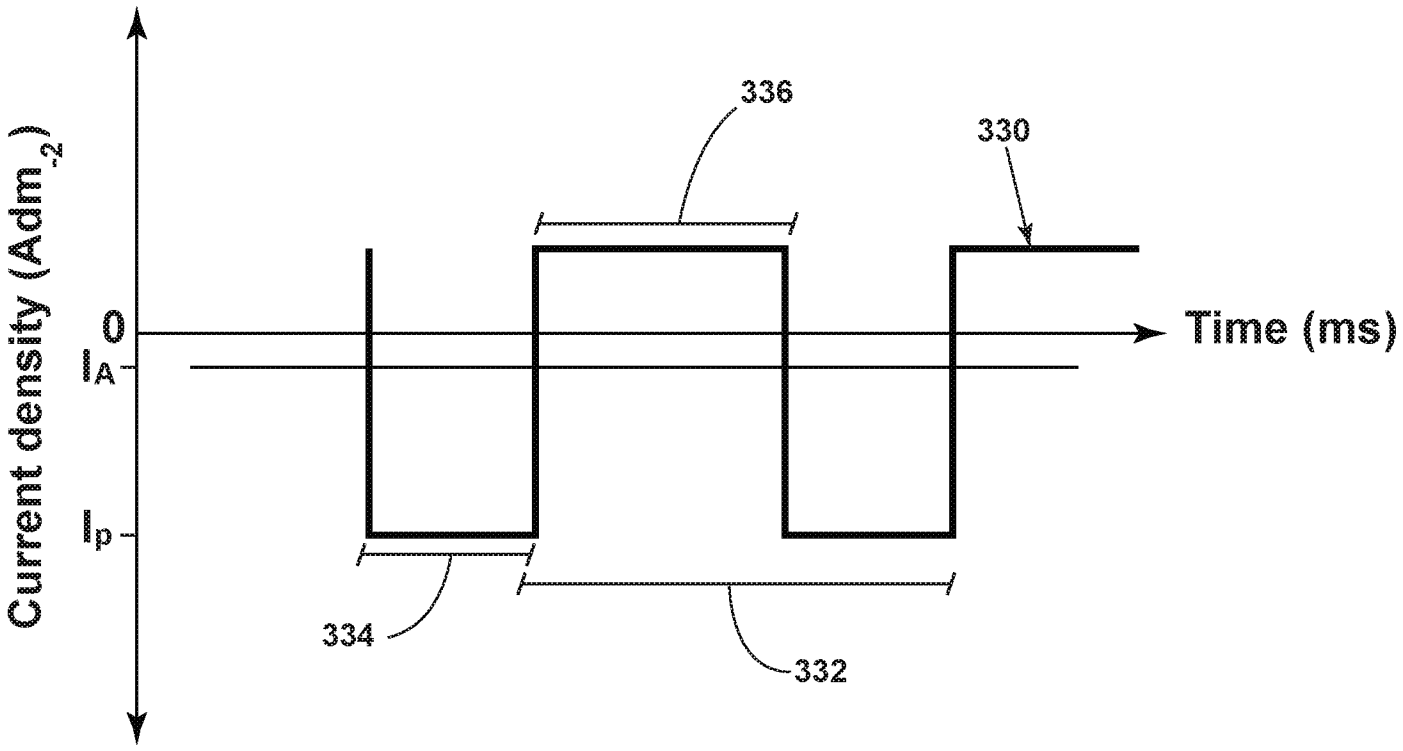
FIG. 18 is a plot graph illustrating a reverse pulsed current to form the component of FIG. 16.

Referring now to FIG. 18, a plot graph 330 illustrates a pulsed reverse current waveform having a periodic cycle 332. An on period 334 is defined supplying a negative current at a particular current density and an off period 336 supplying no current form the periodic cycle 332. The periodic cycle 332 can be representative of a supply of current to the cathode 292 from the anodes 290 of FIG. 12 in electroforming the monolithic component, and may or may not be utilized in combination with the pulsed current waveform of FIG. 17.

The pulsed current waveform of FIG. 17 or the pulsed reverse current of FIG. 18 can be used to generate an electric field in the bath tank 280 of FIG. 12 in order to electroform the monolithic component via electrophoresis. Utilizing the pulsed current or the reversed pulsed current, in combination with other viable such as fluid temperature, can provide for affecting the grain size as well as the molecular organization of the metallic layer of the monolithic body. In the example where the single metal constituent solution 282 of FIG. 12 includes aluminum with manganese ions, the pulse current, reversed current, modulating the current, the amount of current, or the placement of barrier shields can be used to vary the local concentration of the manganese ions on the electroformed monolithic component. These parameters, as well as additional parameters, can be varied to control the amount of manganese in the electroformed component as well as the molecular structure, such as in crystalline or quasicrystalline formations. The use of multiple anodes 290 having multiple power sources can be used to discretely control the local amount of manganese within the separate zones 294, 296, 298, to locally tailor the differing material properties within the zones of the component.

For example, the 0-7.5% concentration of manganese can results in an alloy having grain sizes ranging from 15 to 7 micrometers (μm) forming crystalline structures resulting in a hardness from about 1.0-2.8 gigapascals (GPa). Similarly a concentration of Mn from 8.2-12.3 and 13.6-15.8 can provide much smaller grain sizes in the range of 10-25 nanometers (nm), having a significantly higher hardness between 4.8 and 5.5 GPa. The Mn concentration during electroforming of the heat exchanger 50 can provide for increased hardness for a zone, or alternatively, decreased hardness with increased thermal conductivity. The zones having decreased hardness, as compared to the zones having increased hardness, can have increase thermal conductivity and increased electrical conductivity, such as through crystalline structures formed at 0-7.5% manganese. As such, it should be appreciated that controlling the amount of manganese used to form the monolithic component can be used to determine local material properties such as increased hardness resulting in improved tensile strength, or increased thermal conductivity. While described with respect to aluminum and manganese, it should be appreciated that alternative metal alloys are contemplated. Modifying the concentration of the ions in solutions of such alternative alloys can be adapted to vary the differing metal properties of the particular component.

Utilizing the multiple anodes with multiple power supplies to a common cathode can be used to control the concentration of manganese locally, to tailor the component to have the differing material properties in the different zones. Variation in the parameters such as the pulsed current of FIG. 17 or reversed pulsed reverse current of FIG. 18, as well as other variables such as number of cathodes, multiple power supplies, function generators defined within the controller 310, current thieves, bath temperatures, or positioning of barrier shields 300 can be used to particularly modify or tune the local material properties by controlling the local concentration or crystalline formation of the metallic layer. Particularly, the use of current thieves can be used to locally tune the modulated current density while the location of barrier shields can be used to control the local concentration of the metal alloy, such as the manganese within the single metal constituent solution.

The use of the multiple zone anodes, one or more cathodes, multiple power supplies, current thieves, and barrier shields enables the definition of separate zones for the same monolithic component, permitting a monolithic body to have discrete, local material properties. In the example of the heat exchanger 50 as described in FIG. 4, the fins 90 and the set of fluid passages 82 can have increased thermal conductivity to improve heat transfer, while the manifold connections 74, 76 and the return manifolds 88 can have improved tensile strength to increase component lifetime and minimize required servicing or maintenance.

It should be further appreciated that the heat exchanger as described herein provides for a fully integrated monolithic heat exchanger or surface air-cooled oil cooler. The monolithic body provide for reduced overall cost, weight, assembly-process operations, and component defects. The methods of making the heat exchanger can provide for heat exchanger formed from a stronger alloy of aluminum, which can be as much as three times stronger or more in comparison to current aluminum alloys. The fabrication costs of the monolithic body are reduced by eliminating the need for secondary forming, machining, or welding operations. Furthermore, material waste is minimized without such secondary operations.

The heat exchanger or other components formed by the processes and methods as described herein provide for formation of complex thermal enhancement features, such as the fins as described herein including the shrouds, louvers or other elements, which are not possible with current extrusion or skiving processes. The improved fins provide for minimized fin height, which can reduce overall drag to provide improvements to specific fuel consumption. The shrouds provide for prevention of loss of airflow through the top of the fins. As much as 30-40% of airflow can exit through the top of the channel between the fins. The shrouds provide for minimizing these losses, improving overall heat exchanger efficiency. Similarly, the thermal augmentation structures provide for improved heat transfer within the body. Furthermore, forming the portion of the monolithic body with increased thermal conductivity further improves the efficiency of the heat exchanger.

The heat exchanger also includes improved component durability and longevity, providing for overall cost savings. The electroformed alloys for the monolithic body can provide for strengthened alloys having a greater component lifetime, while reducing required maintenance. The improved strength for the heat exchanger can provide for alloys that are three times stronger than current designs, without significant loss in ductility. The improved strength provides for decreased component thicknesses, which reduces overall weight, mass, and cost.

Furthermore, the heat exchanger of components formed by the electrodeposition methods as described herein can have locally tailored and differing material properties to tailor the component to differing local needs, such as thermal conductivity or structural integrity in non-limiting examples.

The foregoing has described a heat exchanger or surface cooler apparatus. While the present disclosure has been described with respect to a limited number of embodiments, those skilled in the art, having benefit of this disclosure, will appreciate that other embodiments can be devised which do not depart from the scope of the disclosure as described herein. While the present disclosure has been described with reference to exemplary embodiments, it will be understood by those skilled in the art that various changes can be made and equivalents can be substituted for elements thereof without departing from the scope of the disclosure. In addition, many modifications can be made to adapt a particular situation or material to the teachings of the present disclosure without departing from the essential scope thereof. For example, the heat exchanger as described herein can be configured for use in many different types of aircraft engine architectures, or non-aircraft implementations, such as, but not limited to a multi-spool design (additional compressor and turbine section), a geared turbo fan type architecture, engines including un-ducted fans, single shaft engine designs (single compressor and turbine sections), or the like. Therefore, it is intended that the present disclosure not be limited to the particular embodiment disclosed as the best mode contemplated for carrying out the disclosure. It is, therefore, to be understood that the appended claims are intended to cover all such modifications and changes as fall within the true spirit of the disclosure.

To the extent not already described, the different features and structures of the various embodiments can be used in combination with each other as desired. That one feature is not illustrated in all of the embodiments is not meant to be construed that it cannot be, but is done for brevity of description. Thus, the various features of the different embodiments can be mixed and matched as desired to form new embodiments, whether or not the new embodiments are expressly described. All combinations or permutations of features described herein are covered by this disclosure.

This written description uses examples to disclose the invention, including the best mode, and also to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of forming a heat exchanger, the method comprising:

coupling a base plate and a manifold section to a sacrificial mold having an outer surface defining a cathode, the sacrificial mold including a set of return manifolds, at least one manifold connection, and a set of fluid passage channel structures;

providing at least two anodes;

forming, with a controller connected to the at least two anodes, a monolithic component by way of electroforming over the outer surface of the sacrificial mold and the base plate utilizing a single metal constituent solution, and wherein the monolithic component includes at least two discrete zones, complementary to the at least two anodes, with each discrete zone of the at least two discrete zones having differing local material properties within a single layer, the discrete zones having the differing local material properties realized by controlling a local concentration or a crystalline formation during the electroforming of the single layer via the controller connected to the at least two anodes; and removing the sacrificial mold to define the heat exchanger having the monolithic component with a set of fluid passages at least some of which are fluidly coupled via the set of return manifolds.

2. The method of claim 1 wherein the single metal constituent solution includes an aluminum alloy or a nickel alloy.

3. The method of claim 2 wherein the cathode comprises multiple cathodes.

4. The method of claim 3 wherein the electroforming comprises utilizing a pulsed current or a pulsed reverse current.

5. The method of claim 4 wherein controlling the local concentration comprises at least one of providing a barrier shield, varying an amount of reverse current, or modulating a pulse width.

6. The method of claim 3 wherein the electroforming further comprises electroforming a metallic layer utilizing multiple power supplies for at least some anodes of the multiple anodes.

7. The method of claim 1 wherein forming the monolithic component further comprises controlling by electrodeposition an amount of a specified metal in a first zone of the monolithic component wherein the first zone of the monolithic component has an increased thermal conductivity compared to another zone of the monolithic component.

8. The method of claim 7 wherein the forming the monolithic component further comprises controlling by electrodeposition an amount of a specified metal in a second zone of the monolithic component wherein the second zone of the monolithic component has an increased tensile strength compared to the first zone.

9. The method of claim 1 wherein a current density from the at least two anodes can be varied to change the local material properties within each discrete zone of the at least two discrete zones.

10. A method of forming a heat exchanger, the method comprising:

attaching at least one sacrificial mold having an outer surface to a base plate, wherein the at least one sacrificial mold includes a set of return manifolds, at least one manifold connection, and a set of fluid passage channel structures;

electroforming a single metallic layer over exposed outer surfaces of the base plate and the outer surface of the sacrificial mold with a set of anodes including at least two anodes, wherein the electroforming includes controlling an amount of a first specified metal or a crystalline formation in a first zone of the single metallic layer with a first anode of the set of anodes to form a first portion of the heat exchanger, and controlling an amount of a second specified metal or a crystalline formation in a second zone of the single metallic layer with a second anode of the set of anodes to form a second portion of the heat exchanger, the first zone being discrete from the second zone and the first zone and the second zone having differing material properties; and removing the at least one sacrificial mold to define the heat exchanger having a unitary component including the first portion and the second portion and a set of fluid passages at least some of which are fluidly coupled via the set of return manifolds.

11. The method of claim 10 wherein the electroforming comprises electroforming from a single metal constituent solution.

12. The method of claim 11 wherein the single metal constituent solution includes an aluminum alloy or a nickel alloy.

13. The method of claim 12 wherein the electroforming comprises utilizing multiple cathodes to form the first zone and the second zone.

14. The method of claim 13 wherein the electroforming comprises utilizing a pulsed current or a pulsed reverse current.

15. The method of claim 13, further comprising controlling a local concentration of an alloying metal at one of the multiple cathodes.

16. The method of claim 15 wherein controlling the local concentration comprises utilizing a barrier shield to control the local concentration.

17. The method of claim 13 wherein the electroforming the single metallic layer comprises utilizing multiple power supplies for at least some anodes of the set of anodes.

18. The method of claim 10, further comprising metalizing at least one of an exposed portion of the base plate or an exposed portion of the outer surface of the at least one sacrificial mold before electroforming.

19. The method of claim 10 wherein the first zone has an increased thermal conductivity compared to a remainder of the unitary component.

20. The method of claim 19 wherein the second zone has an increased tensile strength compared to another remainder of the unitary component.

* * * * *